US007444791B1

(12) United States Patent
Pervan

(10) Patent No.: US 7,444,791 B1
(45) **Date of Patent: *Nov. 4, 2008**

(54) LOCKING SYSTEM AND FLOORING BOARD

(75) Inventor: Darko Pervan, Viken (SE)

(73) Assignee: Valinge Innovation AB, Viken (SE)

( * ) Notice: Subject to any disclaimer, the term of this patent is extended or adjusted under 35 U.S.C. 154(b) by 0 days.

This patent is subject to a terminal disclaimer.

(21) Appl. No.: 09/714,514

(22) Filed: Nov. 17, 2000

Related U.S. Application Data

(63) Continuation of application No. PCT/SE99/00933, filed on May 31, 1999.

(30) Foreign Application Priority Data

Jun. 3, 1998 (SE) ..... 9801987

(51) Int. Cl.
*E04B 5/02* (2006.01)

(52) U.S. Cl. ..... 52/590.2; 52/578; 52/592.2; 52/589.1; 52/582.2; 52/581

(58) Field of Classification Search ..... 52/578, 52/581, 582.1, 582.2, 587.1, 586.2, 591.1, 52/589.1, 520, 536, 545, 546, 547, 478, 590.2, 52/480, 592.2
See application file for complete search history.

(56) References Cited

U.S. PATENT DOCUMENTS

| | | | |
|---|---|---|---|
| 213,740 | A | 4/1879 | Conner |
| 714,987 | A | 12/1902 | Wolfe |
| 753,791 | A | 3/1904 | Fulghum |
| 1,124,228 | A | 1/1915 | Houston |
| 1,194,636 | A | 8/1916 | Joy |
| 1,371,856 | A | 3/1921 | Cade |
| 1,407,679 | A | 2/1922 | Ruthrauff |
| 1,454,250 | A | 5/1923 | Parsons |
| 1,468,288 | A | 9/1923 | Een |

(Continued)

FOREIGN PATENT DOCUMENTS

| | | | |
|---|---|---|---|
| AT | 218725 | B | 12/1961 |

(Continued)

OTHER PUBLICATIONS

Communication of Notices of Intervention by E.F.P. Floor Products dated Mar. 17, 2000 in European Patent Application 0698162, pp. 1-11 with annex pp. 1-21.

(Continued)

*Primary Examiner*—Phi Dieu Tran A
(74) *Attorney, Agent, or Firm*—Buchanan Ingersoll & Rooney PC

(57) ABSTRACT

A locking system to mechanically joins floorboards together. For horizontal mechanical joining, there is a projecting portion with a locking element which cooperates with a locking groove in an adjacent board. A tongue and groove joint for vertical mechanical joining, has coopering upper abutment surfaces and cooperating lower abutment surfaces which are essentially parallel with the principal plane of the floorboards and of which the lower abutment surfaces are positioned essentially outside the outer vertical plane, i.e. displaced relative to the upper abutment surfaces. The tongue is movable at an angle into the groove and the locking element is insertable into the locking groove by mutual angular movement of the boards about the joint edges.

33 Claims, 8 Drawing Sheets

U.S. PATENT DOCUMENTS

| | | | | |
|---|---|---|---|---|
| 1,477,813 | A | | 12/1923 | Daniels et al. |
| 1,510,924 | A | | 10/1924 | Daniels et al. |
| 1,540,128 | A | | 6/1925 | Houston |
| 1,575,821 | A | | 3/1926 | Daniels |
| 1,602,256 | A | | 10/1926 | Sellin |
| 1,602,267 | A | | 10/1926 | Karwisch |
| 1,615,096 | A | | 1/1927 | Meyers |
| 1,622,103 | A | | 3/1927 | Fulton |
| 1,622,104 | A | | 3/1927 | Fulton |
| 1,637,634 | A | | 8/1927 | Carter |
| 1,644,710 | A | | 10/1927 | Crooks |
| 1,660,480 | A | | 2/1928 | Daniels |
| 1,714,738 | A | | 5/1929 | Smith |
| 1,718,702 | A | | 6/1929 | Pfiester |
| 1,734,826 | A | | 11/1929 | Pick |
| 1,764,331 | A | | 6/1930 | Moratz |
| 1,778,069 | A | | 10/1930 | Fetz |
| 1,787,027 | A | | 12/1930 | Wasleff |
| 1,790,178 | A | | 1/1931 | Sutherland, Jr. |
| 1,809,393 | A | | 6/1931 | Rockwell |
| 1,823,039 | A | | 9/1931 | Gruner |
| 1,859,667 | A | | 5/1932 | Gruner |
| 1,898,364 | A | | 2/1933 | Gynn |
| 1,906,411 | A | | 5/1933 | Potvin |
| 1,929,871 | A | | 10/1933 | Jones |
| 1,940,377 | A | | 12/1933 | Storm |
| 1,953,306 | A | | 4/1934 | Moratz |
| 1,986,739 | A | | 1/1935 | Mitte |
| 1,988,201 | A | | 1/1935 | Hall |
| 2,026,511 | A | | 12/1935 | Storm |
| 2,044,216 | A | | 6/1936 | Klages |
| 2,266,464 | A | | 12/1941 | Kraft |
| 2,276,071 | A | | 3/1942 | Scull |
| 2,324,628 | A | | 7/1943 | Kähr |
| 2,398,632 | A | | 4/1946 | Frost et al. |
| 2,430,200 | A | | 11/1947 | Wilson |
| 2,495,862 | A | | 1/1950 | Osborn |
| 2,740,167 | A | | 4/1956 | Rowley |
| 2,780,253 | A | | 2/1957 | Joa |
| 2,851,740 | A | | 9/1958 | Baker |
| 2,865,058 | A | | 12/1958 | Andersson et al. |
| 2,894,292 | A | | 7/1959 | Gramelspacher |
| 2,947,040 | A | | 8/1960 | Schultz |
| 3,045,294 | A | | 7/1962 | Livezey, Jr. |
| 3,100,556 | A | | 8/1963 | De Ridder |
| 3,120,083 | A | | 2/1964 | Dahlberg et al. |
| 3,125,138 | A | | 3/1964 | Bolenbach |
| 3,182,769 | A | | 5/1965 | De Ridder |
| 3,200,553 | A | | 8/1965 | Frashour et al. |
| 3,203,149 | A | | 8/1965 | Soddy |
| 3,247,638 | A | | 4/1966 | Gay, Jr. |
| 3,267,630 | A | | 8/1966 | Omholt |
| 3,282,010 | A | | 11/1966 | King, Jr. |
| 3,301,147 | A | | 1/1967 | Clayton et al. |
| 3,310,919 | A | | 3/1967 | Bue et al. |
| 3,347,048 | A | * | 10/1967 | Brown et al. ..... 52/589.1 |
| 3,377,931 | A | | 4/1968 | Hilton |
| 3,387,422 | A | | 6/1968 | Wanzer |
| 3,460,304 | A | | 8/1969 | Braeuninger et al. |
| 3,481,810 | A | | 12/1969 | Waite |
| 3,508,523 | A | | 4/1970 | De Meerleer et al. |
| 3,526,420 | A | | 9/1970 | Brancalcone |
| 3,538,665 | A | | 11/1970 | Gohner |
| 3,548,559 | A | | 12/1970 | Levine |
| 3,553,919 | A | | 1/1971 | Omholt |
| 3,555,762 | A | | 1/1971 | Costanzo, Jr. |
| 3,579,941 | A | | 5/1971 | Tibbals |
| 3,694,983 | A | | 10/1972 | Couquet |
| 3,714,747 | A | | 2/1973 | Curran |
| 3,731,445 | A | | 5/1973 | Hoffmann et al. |
| 3,759,007 | A | | 9/1973 | Thiele |
| 3,768,846 | A | | 10/1973 | Hensley et al. |
| 3,786,608 | A | | 1/1974 | Boettcher |
| 3,842,562 | A | | 10/1974 | Daigle |
| 3,857,749 | A | | 12/1974 | Yoshida |
| 3,859,000 | A | | 1/1975 | Webster |
| 3,902,293 | A | | 9/1975 | Witt et al. |
| 3,908,053 | A | | 9/1975 | Hettich |
| 3,936,551 | A | | 2/1976 | Elmendorf et al. |
| 3,988,187 | A | | 10/1976 | Witt et al. |
| 4,037,377 | A | | 7/1977 | Howell et al. |
| 4,084,996 | A | | 4/1978 | Wheeler |
| 4,090,338 | A | | 5/1978 | Bourgade |
| 4,099,358 | A | | 7/1978 | Compaan |
| 4,100,710 | A | | 7/1978 | Kowallik |
| 4,169,688 | A | | 10/1979 | Toshio |
| 4,227,430 | A | | 10/1980 | Jansson et al. |
| 4,242,390 | A | | 12/1980 | Nemeth |
| 4,299,070 | A | | 11/1981 | Oltmanns et al. |
| 4,304,083 | A | | 12/1981 | Anderson |
| 4,426,820 | A | * | 1/1984 | Terbrack et al. ..... 52/594 |
| 4,471,012 | A | | 9/1984 | Maxwell |
| 4,489,115 | A | | 12/1984 | Layman et al. |
| 4,501,102 | A | | 2/1985 | Knowles |
| 4,561,233 | A | | 12/1985 | Harter et al. |
| 4,567,706 | A | | 2/1986 | Wendt |
| 4,612,074 | A | | 9/1986 | Smith et al. |
| 4,612,745 | A | | 9/1986 | Hovde |
| 4,641,469 | A | | 2/1987 | Wood |
| 4,643,237 | A | | 2/1987 | Rosa |
| 4,646,494 | A | | 3/1987 | Saarinen et al. |
| 4,648,165 | A | | 3/1987 | Whitehorne |
| 4,653,242 | A | | 3/1987 | Ezard |
| 4,703,597 | A | | 11/1987 | Eggemar |
| 4,715,162 | A | | 12/1987 | Brightwell |
| 4,716,700 | A | | 1/1988 | Hagemeyer |
| 4,738,071 | A | | 4/1988 | Ezard |
| 4,769,963 | A | | 9/1988 | Meyerson |
| 4,819,932 | A | | 4/1989 | Trotter, Jr. |
| 4,822,440 | A | | 4/1989 | Hsu et al. |
| 4,831,806 | A | | 5/1989 | Niese et al. |
| 4,845,907 | A | | 7/1989 | Meek |
| 4,905,442 | A | | 3/1990 | Daniels |
| 5,029,425 | A | | 7/1991 | Bogataj |
| 5,113,632 | A | | 5/1992 | Hanson |
| 5,117,603 | A | | 6/1992 | Weintraub |
| 5,148,850 | A | | 9/1992 | Urbanick |
| 5,165,816 | A | * | 11/1992 | Parasin ..... 403/334 |
| 5,179,812 | A | | 1/1993 | Hill |
| 5,216,861 | A | | 6/1993 | Meyerson |
| 5,253,464 | A | | 10/1993 | Nilsen |
| 5,271,564 | A | | 12/1993 | Smith |
| 5,286,545 | A | | 2/1994 | Simmons, Jr. |
| 5,295,341 | A | | 3/1994 | Kajiwara |
| 5,349,796 | A | | 9/1994 | Meyerson |
| 5,390,457 | A | | 2/1995 | Sjölander |
| 5,433,806 | A | | 7/1995 | Pasquali et al. |
| 5,474,831 | A | | 12/1995 | Nystrom |
| 5,497,589 | A | | 3/1996 | Porter |
| 5,502,939 | A | | 4/1996 | Zadok et al. |
| 5,540,025 | A | | 7/1996 | Takehara et al. |
| 5,560,569 | A | | 10/1996 | Schmidt |
| 5,567,497 | A | | 10/1996 | Zegler et al. |
| 5,570,554 | A | | 11/1996 | Searer |
| 5,597,024 | A | | 1/1997 | Bolyard et al. |
| 5,613,894 | A | | 3/1997 | Delle Vedove |
| 5,618,602 | A | | 4/1997 | Nelson |
| 5,630,304 | A | | 5/1997 | Austin |
| 5,653,099 | A | | 8/1997 | MacKenzie |
| 5,671,575 | A | | 9/1997 | Wu |
| 5,695,875 | A | | 12/1997 | Larsson et al. |
| 5,706,621 | A | | 1/1998 | Pervan |
| 5,755,068 | A | | 5/1998 | Ormiston |
| 5,768,850 | A | | 6/1998 | Chen |

| | | | | |
|---|---|---|---|---|
| 5,797,237 | A * | 8/1998 | Finkell, Jr. | 52/589.1 |
| 5,823,240 | A | 10/1998 | Bolyard et al. | |
| 5,827,592 | A | 10/1998 | Van Gulik et al. | |
| 5,860,267 | A | 1/1999 | Pervan | |
| 5,899,038 | A | 5/1999 | Stroppiana | |
| 5,900,099 | A | 5/1999 | Sweet et al. | |
| 5,925,211 | A | 7/1999 | Rakauskas | |
| 5,935,668 | A | 8/1999 | Smith | |
| 5,943,239 | A | 8/1999 | Shamblin et al. | |
| 5,968,625 | A | 10/1999 | Hudson | |
| 5,987,839 | A | 11/1999 | Hamar et al. | |
| 6,006,486 | A * | 12/1999 | Moriau et al. | 52/589.1 |
| 6,023,907 | A | 2/2000 | Pervan | |
| 6,029,416 | A | 2/2000 | Andersson | |
| 6,094,882 | A | 8/2000 | Pervan | |
| 6,101,778 | A | 8/2000 | Mårtensson | |
| 6,119,423 | A | 9/2000 | Costantino | |
| 6,134,854 | A | 10/2000 | Stanchfield | |
| 6,148,884 | A | 11/2000 | Bolyard et al. | |
| 6,173,548 | B1 | 1/2001 | Hamar et al. | |
| 6,182,410 | B1 | 2/2001 | Pervan | |
| 6,203,653 | B1 | 3/2001 | Seidner | |
| 6,205,639 | B1 | 3/2001 | Pervan | |
| 6,209,278 | B1 | 4/2001 | Tychsen | |
| 6,216,403 | B1 | 4/2001 | Belbeoc'h | |
| 6,216,409 | B1 | 4/2001 | Roy et al. | |
| 6,247,285 | B1 | 6/2001 | Moebus | |
| 6,314,701 | B1 | 11/2001 | Meyerson | |
| 6,324,803 | B1 | 12/2001 | Pervan | |
| 6,345,481 | B1 | 2/2002 | Nelson | |
| 6,397,547 | B1 | 6/2002 | Martensson | |
| 6,421,970 | B1 | 7/2002 | Martensson et al. | |
| 6,438,919 | B1 | 8/2002 | Knauseder | |
| 6,490,836 | B1 | 12/2002 | Moriau et al. | |
| 6,497,079 | B1 | 12/2002 | Pletzer | |
| 6,505,452 | B1 | 1/2003 | Hannig et al. | |
| 6,510,665 | B2 | 1/2003 | Pervan | |
| 6,516,579 | B1 | 2/2003 | Pervan | |
| 6,536,178 | B1 | 3/2003 | Palsson et al. | |
| 6,584,747 | B2 | 7/2003 | Kettler et al. | |
| 6,601,359 | B2 | 8/2003 | Olofsson | |
| 6,606,834 | B2 | 8/2003 | Martensson et al. | |
| 6,647,689 | B2 | 11/2003 | Pletzer et al. | |
| 6,647,690 | B1 | 11/2003 | Martensson | |
| 6,670,019 | B2 | 12/2003 | Andersson | |
| 6,722,809 | B2 | 4/2004 | Hamberger et al. | |
| 6,763,643 | B1 | 7/2004 | Martensson | |
| 6,769,219 | B2 | 8/2004 | Schwitte et al. | |
| 6,786,019 | B2 | 9/2004 | Thiers | |
| 6,854,235 | B2 | 2/2005 | Martensson | |
| 6,874,292 | B2 | 4/2005 | Moriau et al. | |
| 6,918,220 | B2 | 7/2005 | Pervan | |
| 6,922,964 | B2 | 8/2005 | Pervan | |
| 6,933,043 | B1 | 8/2005 | Son et al. | |
| 7,022,189 | B2 | 4/2006 | Delle Vedove | |
| 7,040,068 | B2 | 5/2006 | Moriau et al. | |
| 7,051,486 | B2 | 5/2006 | Pervan | |
| 7,121,059 | B2 | 10/2006 | Pervan | |
| 7,127,860 | B2 | 10/2006 | Pervan | |
| 7,137,229 | B2 | 11/2006 | Pervan | |
| 2001/0029720 | A1 | 10/2001 | Pervan | |
| 2001/0034992 | A1 | 11/2001 | Pletzer et al. | |
| 2002/0007608 | A1 | 1/2002 | Pervan | |
| 2002/0007609 | A1 | 1/2002 | Pervan | |
| 2002/0014047 | A1 | 2/2002 | Thiers | |
| 2002/0020127 | A1 | 2/2002 | Thiers et al. | |
| 2002/0046528 | A1 | 4/2002 | Pervan et al. | |
| 2002/0083673 | A1 | 7/2002 | Kettler et al. | |
| 2002/0095894 | A1 | 7/2002 | Pervan | |
| 2002/0100231 | A1 | 8/2002 | Miller et al. | |
| 2002/0112433 | A1 | 8/2002 | Pervan | |
| 2002/0178673 | A1 | 12/2002 | Pervan | |
| 2002/0178674 | A1 | 12/2002 | Pervan | |
| 2002/0178682 | A1 | 12/2002 | Pervan | |
| 2003/0009972 | A1 | 1/2003 | Pervan et al. | |
| 2003/0041545 | A1 | 3/2003 | Stanchfield | |
| 2003/0084636 | A1 | 5/2003 | Pervan | |
| 2003/0101681 | A1 | 6/2003 | Tychsen | |
| 2003/0233809 | A1 | 12/2003 | Pervan | |
| 2004/0139678 | A1 | 7/2004 | Pervan | |
| 2004/0177584 | A1 | 9/2004 | Pervan | |
| 2004/0206036 | A1 | 10/2004 | Pervan | |
| 2004/0241374 | A1 | 12/2004 | Thiers et al. | |
| 2004/0255541 | A1 | 12/2004 | Thiers et al. | |
| 2005/0034404 | A1 | 2/2005 | Pervan | |
| 2005/0034405 | A1 | 2/2005 | Pervan | |
| 2005/0055943 | A1 | 3/2005 | Pervan | |
| 2005/0102937 | A1 | 5/2005 | Pervan | |
| 2005/0138881 | A1 | 6/2005 | Pervan | |
| 2005/0160694 | A1 | 7/2005 | Pervan | |
| 2005/0161468 | A1 | 7/2005 | Wagner | |
| 2005/0166516 | A1 | 8/2005 | Pervan | |
| 2005/0193677 | A1 | 9/2005 | Voegel | |
| 2005/0208255 | A1 | 9/2005 | Pervan | |
| 2005/0210810 | A1 | 9/2005 | Pervan | |
| 2005/0235593 | A1 | 10/2005 | Hecht | |
| 2005/0268570 | A2 | 12/2005 | Pervan | |
| 2006/0048474 | A1 | 3/2006 | Pervan | |
| 2006/0070333 | A1 | 4/2006 | Pervan | |
| 2006/0073320 | A1 | 4/2006 | Pervan | |
| 2006/0075713 | A1 | 4/2006 | Pervan et al. | |
| 2006/0101769 | A1 | 5/2006 | Pervan | |
| 2006/0117696 | A1 | 6/2006 | Pervan | |
| 2006/0179773 | A1 | 8/2006 | Pervan | |
| 2006/0196139 | A1 | 9/2006 | Pervan | |
| 2006/0236642 | A1 | 10/2006 | Pervan | |
| 2006/0260254 | A1 | 11/2006 | Pervan | |
| 2006/0283127 | A1 | 12/2006 | Pervan | |
| 2007/0119110 | A1 | 5/2007 | Pervan | |
| 2007/0159814 | A1 | 7/2007 | Jacobsson | |

FOREIGN PATENT DOCUMENTS

| | | | |
|---|---|---|---|
| AU | 713628 | | 1/1998 |
| AU | 200020703 | A1 | 6/2000 |
| BE | 417526 | | 9/1936 |
| BE | 0557844 | | 6/1957 |
| BE | 1010339 | A3 | 6/1998 |
| BE | 1010487 | A6 | 10/1998 |
| CA | 0991373 | | 6/1976 |
| CA | 2226286 | | 12/1997 |
| CA | 2252791 | | 5/1999 |
| CA | 2289309 | | 7/2000 |
| CA | 2 363 184 | | 7/2001 |
| CH | 200949 | | 1/1939 |
| CH | 211877 | | 1/1941 |
| DE | 1 212 275 | | 3/1966 |
| DE | 7102476 | | 1/1971 |
| DE | 2 159 042 | | 11/1971 |
| DE | 1534278 | | 11/1971 |
| DE | 2 205 232 | | 8/1973 |
| DE | 7402354 | | 1/1974 |
| DE | 2 238 660 | | 2/1974 |
| DE | 2 252 643 | | 5/1974 |
| DE | 2502992 | | 7/1976 |
| DE | 2616077 | | 10/1977 |
| DE | 2917025 | | 11/1980 |
| DE | 30 41781 | A1 | 6/1982 |
| DE | 32 14 207 | A1 | 11/1982 |
| DE | 32 46 376 | C6 | 6/1984 |
| DE | 33 43 601 | | 6/1985 |
| DE | 3343601 | A1 | 6/1985 |
| DE | 35 38 538 | A1 | 10/1985 |
| DE | 8604004 | | 6/1986 |
| DE | 3512204 | A1 | 10/1986 |
| DE | 33 43 601 | C2 | 2/1987 |

| | | | | | |
|---|---|---|---|---|---|
| DE | 35 44845 | A1 | 6/1987 | | |
| DE | 36 31 390 | A1 | 12/1987 | | |
| DE | 40 02 547 | A1 | 8/1991 | | |
| DE | 41 30 115 | A1 | 9/1991 | | |
| DE | 4134452 | A1 | 4/1993 | | |
| DE | 4215273 | A1 | 11/1993 | | |
| DE | 4242530 | A1 | 6/1994 | | |
| DE | 43 13 037 | C1 | 8/1994 | | |
| DE | 296 10 462 | | 10/1996 | | |
| DE | 196 01 322 | A1 | 5/1997 | | |
| DE | 296 18 318 | U1 | 5/1997 | | |
| DE | 29710175 | U1 | 9/1997 | | |
| DE | 196 51 149 | A1 | 6/1998 | | |
| DE | 19651149 | A1 | 6/1998 | | |
| DE | 197 09 641 | A1 | 9/1998 | | |
| DE | 197 18 319 | A1 | 11/1998 | | |
| DE | 197 18 812 | A1 | 11/1998 | | |
| DE | 299 22 649 | U1 | 4/2000 | | |
| DE | 200 01 225 | U1 | 8/2000 | | |
| DE | 200 02 744 | U1 | 9/2000 | | |
| DE | 199 25 248 | A1 | 12/2000 | | |
| DE | 200 13 380 | | 12/2000 | | |
| DE | 200 17 461 | U1 | 3/2001 | | |
| DE | 200 18 284 | U1 | 3/2001 | | |
| DE | 100 01 248 | | 7/2001 | | |
| DE | 203 07 580 | U1 | 7/2003 | | |
| DE | 20 2004 001 038 | U1 | 5/2004 | | |
| DE | 20 2005 006 300 | U1 | 8/2005 | | |
| DE | 10 2004 054 368 | A1 | 5/2006 | | |
| EP | 0248127 | A1 | 12/1987 | | |
| EP | 0 487 925 | A1 | 6/1992 | | |
| EP | 0 623 724 | A1 | 11/1994 | | |
| EP | 0698162 | B1 | 11/1994 | | |
| EP | 0652340 | A1 | 5/1995 | | |
| EP | 0 665 347 | | 8/1995 | | |
| EP | 0 690 185 | A1 | 1/1996 | | |
| EP | 0843763 | B1 | 12/1997 | | |
| EP | 0849416 | A2 | 6/1998 | | |
| EP | 0855482 | B1 | 7/1998 | | |
| EP | 0877130 | B1 | 11/1998 | | |
| EP | 0958441 | | 11/1998 | | |
| EP | 0 661 135 | B1 | 12/1998 | | |
| EP | 0903451 | A2 | 3/1999 | | |
| EP | 0969163 | A2 | 1/2000 | | |
| EP | 0969163 | A3 | 1/2000 | | |
| EP | 0969164 | A2 | 1/2000 | | |
| EP | 0969164 | A3 | 1/2000 | | |
| EP | 0974713 | A1 | 1/2000 | | |
| EP | 0 976 889 | | 2/2000 | | |
| EP | 1 251 219 | A1 | 7/2001 | | |
| EP | 1 165 906 | | 1/2002 | | |
| EP | 1 223 265 | | 7/2002 | | |
| EP | 1 317 983 | A2 | 6/2003 | | |
| EP | 1 338 344 | A2 | 8/2003 | | |
| FI | 843060 | | 8/1984 | | |
| FR | 1293043 | | 4/1962 | | |
| FR | 2 568 295 | | 1/1986 | | |
| FR | 2630149 | | 10/1989 | | |
| FR | 2 637 932 | A1 | 4/1990 | | |
| FR | 2675174 | | 10/1992 | | |
| FR | 2691491 | | 11/1993 | | |
| FR | 2 697 275 | | 4/1994 | | |
| FR | 2 712 329 | A1 | 5/1995 | | |
| FR | 2 781 513 | A1 | 1/2000 | | |
| FR | 2 785 633 | A1 | 5/2000 | | |
| GB | 240629 | | 10/1925 | | |
| GB | 424057 | | 2/1935 | | |
| GB | 585205 | | 1/1947 | | |
| GB | 599793 | | 3/1948 | | |
| GB | 636423 | | 4/1950 | | |
| GB | 812671 | | 4/1959 | | |
| GB | 1127915 | | 10/1968 | | |
| GB | 1171337 | | 11/1969 | | |
| GB | 1237744 | | 6/1971 | | |
| GB | 1275511 | | 5/1972 | | |
| GB | 1 394 621 | | 5/1975 | | |
| GB | 1430423 | | 3/1976 | | |
| GB | 2117813 | | 10/1983 | | |
| GB | 2 126 106 | A | 3/1984 | | |
| GB | 2243381 | | 10/1991 | | |
| GB | 2256023 | | * 11/1992 | ..... | 52/578 |
| JP | 54-65528 | | 5/1979 | | |
| JP | 57-119056 | | 7/1982 | | |
| JP | 57-185110 | | 11/1982 | | |
| JP | 59-186336 | | 11/1984 | | |
| JP | 3-169967 | | 7/1991 | | |
| JP | 4-106264 | | 4/1992 | | |
| JP | 4-191001 | | 7/1992 | | |
| JP | 5-148984 | | 6/1993 | | |
| JP | 6-56310 | | 5/1994 | | |
| JP | 6-146553 | | 5/1994 | | |
| JP | 6-320510 | | 11/1994 | | |
| JP | 7-076923 | | 3/1995 | | |
| JP | 7-180333 | | 7/1995 | | |
| JP | 7-300979 | | 11/1995 | | |
| JP | 7-310426 | | 11/1995 | | |
| JP | 8-109734 | | 4/1996 | | |
| JP | 9-38906 | | 2/1997 | | |
| JP | 9-88315 | | 3/1997 | | |
| JP | 2000-179137 | | 6/2000 | | |
| NL | 7601773 | | 8/1976 | | |
| NO | 157871 | | 7/1984 | | |
| NO | 305614 | | 5/1995 | | |
| PL | 24931 | U | 11/1974 | | |
| PL | 26931 | U | 11/1974 | | |
| SE | 372 051 | | 5/1973 | | |
| SE | 450 141 | | 6/1984 | | |
| SE | 501 014 | C2 | 10/1994 | | |
| SE | 293981 | | * 3/1995 | ..... | 52/590.1 |
| SE | 502994 | | 3/1996 | | |
| SE | 506 254 | C2 | 11/1997 | | |
| SE | 509059 | | 6/1998 | | |
| SE | 509060 | | 6/1998 | | |
| SE | 512290 | | 12/1999 | | |
| SE | 512313 | | 12/1999 | | |
| SE | 0000200-6 | | 7/2001 | | |
| SU | 363795 | | 11/1973 | | |
| SU | 1680359 | A1 | 9/1991 | | |
| WO | WO 84/02155 | | 6/1984 | | |
| WO | WO87/03839 | A1 | 7/1987 | | |
| WO | WO 92/17657 | | 10/1992 | | |
| WO | WO 93/13280 | | 7/1993 | | |
| WO | WO 94/01628 | | 1/1994 | | |
| WO | WO 94/26999 | | 11/1994 | | |
| WO | WO 96/27719 | | 9/1996 | | |
| WO | WO 96/27721 | | 9/1996 | | |
| WO | WO96/30177 | A1 | 10/1996 | | |
| WO | WO 97/19232 | | 5/1997 | | |
| WO | WO 97/47834 | | 12/1997 | | |
| WO | WO 98/22677 | A1 | 5/1998 | | |
| WO | WO 98/24994 | | 6/1998 | | |
| WO | WO 98/24995 | | 6/1998 | | |
| WO | WO98/38401 | A1 | 9/1998 | | |
| WO | WO99/40273 | A1 | 8/1999 | | |
| WO | WO 99/66151 | | 12/1999 | | |
| WO | WO99/66151 | A1 | 12/1999 | | |
| WO | WO 99/66152 | | 12/1999 | | |
| WO | WO 00/06854 | | 1/2000 | | |
| WO | WO00/66856 | A1 | 11/2000 | | |
| WO | WO 01/02669 | A1 | 1/2001 | | |
| WO | 01/51733 | A1 | 7/2001 | | |
| WO | 01/66876 | A1 | 9/2001 | | |
| WO | 02/055809 | A1 | 7/2002 | | |
| WO | 02/058810 | A1 | 7/2002 | | |
| WO | 03/070384 | A1 | 8/2003 | | |
| WO | 03/078761 | A1 | 9/2003 | | |

| | | | |
|---|---|---|---|
| WO | 03/099461 | A1 | 12/2003 |
| WO | 2005/077625 | A1 | 8/2005 |
| WO | 2005/110677 | A1 | 11/2005 |
| WO | 2006/008578 | A1 | 1/2006 |
| WO | 2006/111437 | A1 | 10/2006 |
| WO | 2006/113757 | A2 | 10/2006 |

OTHER PUBLICATIONS

Response to the E.F.P. Floor Products intervention dated Jun. 28, 2000, pp. 1-5.
Letters from the Opponent dated Jul. 26, 2001 and Jul. 30, 2001 including Annexes 1 to 3.
Knight's American Mechanical Dictionary, Hurd and Houghton: New York (1876), p. 2051.
Communication from European Patent Office dated Sep. 20, 2001 in European Patent No. 0698162, pp. 1-2 with Facts and Submissions Annex pp. 1-18, Minutes Annex pp. 1-11, and Annex I to VI.
Communication from Swedish Patent Office dated Sep. 21, 2001 in Swedish Patent No. 9801986-2, pp. 1-3 in Swedish with forwarding letter dated Sep. 24, 2001 in English.
European prosecution file history to grant, European Patent No. 94915725.9-2303/0698162, grant date Sep. 16, 1998.
European prosecution file history to grant, European Patent No. 98106535.2-2303/0855482, grant date Dec. 1, 1999.
European prosecution file history to grant, European Patent No. 98201555.4-2303/0877130, grant date Jan. 26, 2000.
Träindustrins Handbook "Snickeriarbete", 2nd Edition, Malmö 1952, pp. 826, 827, 854, and 855, published by Teknografiska Aktiebolaget, Sweden.
"Träbearbetning", Anders Grönlund, 1986, ISBN 91-970513-2-2, pp. 357-360, published by Institute for Trateknisk Forskning, Stockholm, Sweden.
Drawing Figure 25/6107 from Buetec Gmbh dated Dec. 16, 1985.
Pamphlet from Serexhe for Compact-Praxis, entitled "Selbst Teppichböden, PVC und Parkett verlegen", Published by Compact Verlag, München, Germany 1985, pp. 84-87.
Pamphlet from Junckers Industrser A/S entitled "Bøjlesystemet til Junckers boliggulve" Oct. 1994, , Published by Junckers Industrser A/S, Denmark.
Pamphlet from Junckers Industrser A/S entitled "The Clip System for Junckers Sports Floors", Annex 7, 1994, Published by Junckers Industrser A/S, Denmark.
Pamphlet from Junckers Industrser A/S entitled "The Clip System for Junckers Domestic Floors", Annex 8, 1994, Published by Junckers Industrser A/S, Denmark.
Fibo-Trespo Alloc System Brochure entitled "Opplæring OG Autorisasjon", pp. 1-29, Fibo-Trespo.
"Revolution bei der Laminatboden-Verl", boden wand decke, vol. No. 11 of 14, Jan. 10, 1997, p. 166.
Kährs Focus Extra dated Jan. 2001, pp. 1-9.
Brochure for CLIC Laminate Flooring, Art.-Nr. 110 11 640.
Brochure for Laminat-Boden "Clever-Click", Parador® Wohnsysteme.
Brochure for Pergo®, CLIC Laminate Flooring, and Prime Laminate Flooring from Bauhaus, The Home Store, Malmö, Sweden.
Webster's Dictionary, p. 862.
Opposition EP 0.698,162 B1—Facts-Grounds-Arguments, dated Apr. 1, 1999, pp. 1-56.
Opposition II EP 0.698,162 B1—Facts-Grounds-Arguments, dated Apr. 30, 1999, (17 pages)—with translation (11 pages).
Opposition I: Unilin Decor N.V./Välinge Aluminum AB, communication dated Jun. 8, 1999 to European Patent Office, pp. 1-2.
Opposition I: Unilin Decor N.V./Välinge Aluminum AB, communication dated Jun. 16, 1999 to European Patent Office, pp. 1-2.
FI Office Action dated Mar. 19, 1998.
NO Office Action dated Dec. 22, 1997.
NO Office Action dated Sep. 21, 1998.
Opposition EP 0.877.130 B1—Facts—Arguments, dated Jun. 28, 2000, pp. 1-13.
RU Application Examiner Letter dated Sep. 26, 1997.
NZ Application Examiner Letter dated Oct. 21, 1999.
Välinge, Fibo-Trespo Brochure, Distributed at the Domotex Fair In Hannover, Germany, Jan. 1996.
*Pergo, Inc.* v. *Välinge Aluminium AB, Berry Finance NV, and Alloc, Inc.*; U.S. District Court for the District of Columbia; Civil Action No. 1:00CV01618.
*Alloc, Inc.* v. *Unilin Decor NV and BHK of America, Inc.*; U.S. District Court for the Eastern District of Wisconsin; Civil Action No. 00-C-0999.
*Unilin Beheer B.V., Unilin Decor, N.V., and BHK of America, Inc.* v. *Välinge Aluminium AB*; U.S. District Court for the District of Columbia; Civil Action No. 1:00CV01823.
*Alloc, Inc., Berry Finance NV, and Välinge Aluminium AB* v. *Unilin Decor NV, BHK of America, Inc., Pergo, Inc., Meister-Leisten Schulte GmbH, Akzenta Paneele + Profile GmbH, Tarkett, Inc., and Roysol*; ITC No. 337-TA-443 Filed Dec. 4, 2000.
*Alloc, Inc., Berry Finance NV, and Välinge Aluminium AB* v. *Tarkett, Inc.*; U.S. District Court for the Eastern District of Wisconsin; Civil Action No. 00-CV-1377.
Tony Pervan, U.S. Appl. No. 09/534,007 entitled "*System for Joining Building Boards*" filed Mar. 24, 2000.
Darko Pervan, U.S. Appl. No. 09/679,300 entitled "*Locking System and Flooring Board*" filed Oct. 6, 2000.
Darko Pervan, U.S. Appl. No. 10/043,149 entitled "*Floorboards And Methods For Production And Installation Thereof*" filed Jan. 14, 2002.
Darko Pervan, U.S. Appl. No. 10/043,424 entitled "*Floorboards And Locking System Thereof*" filed Jan. 14, 2002.
Darko Pervan, U.S. Appl. No. 10/100,032 entitled "*Locking System and Flooring Board*" filed Mar. 19, 2002.
Darko Pervan, U.S. Appl. No. 10/413,478 entitled "Mechanical Locking System for Floating Floor" filed Apr. 15, 2003.
Darko Pervan, U.S. Appl. No. 10/413,479 entitled "Floorboards for Floating Floor" filed Apr. 15, 2003.
Darko Pervan, U.S. Appl. No. 10/413,566 entitled "Floorboards with Decorative Grooves" filed Apr. 15, 2003.
Darko Pervan, U.S. Appl. No. 10/359,615 entitled "Locking System for Floorboards", filed Feb. 7, 2003.
Darko Pervan, U.S. Appl. No. 10/361,815 entitled "Locking System and Flooring Boards", filed Feb. 11, 2003.
Tony Pervan, U.S. Appl. No. 10/430,273 entitled "System for Joining Building Boards", filed May 7, 2003.
Darko Pervan, U.S. Appl. No. 10/808,455 entitled "Flooring and Method for Installation and Manufacturing Thereof" filed Mar. 25, 2004.
Darko Pervan et al., U.S. Appl. No. 10/205,395 entitled "*Floor Panel with Sealing Means*" filed Jul. 26, 2002.
Darko Pervan et al., U.S. Appl. No. 10/235,940 entitled "*Flooring and Method for Laying and Manufacturing the Same*" filed Sep. 6, 2002.
Darko Pervan U.S. Appl. No. 10/256,167 entitled "*Locking System for Mechanical Joining of Floorboards and Method for Production Thereof*" filed Sep. 27, 2002.
Darko Pervan et al., U.S. Appl. No. 10/508,198 entitled "Floorboards With Decorative Grooves" filed Sep. 20, 2004.
Darko Pervan, U.S. Appl. No. 10/509,885 entitled "Mechanical Locking System for Floorboards" filed Oct. 4, 2004.
Darko Pervan, U.S. Appl. No. 10/510,580 entitled "Floorboards for Floorings" filed Oct. 8, 2004.
Darko Pervan, U.S. Appl. No. 10/970,282 entitled "Mechanical Locking System for Floor Panels" filed Oct. 22, 2004.
Darko Pervan, U.S. Appl. No. 10/975,923 entitled "Flooring Systems and Methods for Installation" filed Oct. 29, 2004.
Darko Pervan, U.S. Appl. No. 11/000,912 entitled "Floorboard, System and Method for Forming a Flooring, and Flooring Formed Thereof" filed Dec. 2, 2004.
Darko Pervan, U.S. Appl. No. 11/008,213 entitled "Metal Strip for Interlocking Floorboard and a Floorbaord Using Same" filed Dec. 10, 2004.
Darko Pervan, U.S. Appl. No. 11/034,059 entitled "Floor Covering and Locking System" filed Jan. 13, 2005.
Darko Pervan, U.S. Appl. No. 11/034,060 entitled "Floor Covering and Locking System" filed Jan. 13, 2005.

Darko Pervan, U.S. Appl. No. 10/906,356 entitled "Building Panel With Compressed Edges and Method of Making Same" filed Feb. 15, 2005.
Darko Pervan, U.S. Appl. No. 11/092,748 entitled "Mechanical Locking System for Panels and Method of Installing Same" filed Mar. 30, 2005.
Darko Pervan, U.S. Appl. No. 10/908,658 entitled "Mechanical Locking System for Floor Panels" filed May 20, 2005.
Darko Pervan et al, U.S. Appl. No. 11/161,520 entitled "Method of Making a Floorboard and Mehtod of Making a Floor With the Floorboard" filed Aug. 6, 2005.
Darko Pervan et al, U.S. Appl. No. 11/163,085 entitled "Appliance and Method for Surface Treatment of a Board Shaped Material and Floorboard" filed Oct. 4, 2005.
Correspondence from Bütec cited during opposition procedure at EPO in DE Patent No. 3343601, including announcement of Oct. 1984 re "Das Festprogram von Bütec: Mehrzweckbühnen, tanzplatten, Schonbeläge, Tanzbeläge, Bestuhlung"; letter of Nov. 7, 2001 to Perstorp Support AB with attached brochure published Oct. 1984 and installation instructions published Nov. 1984; and letter of Nov. 19, 2001 to Perstorp Support AB.
Jacobsson, Jan, et al., U.S. Appl. No. 11/521,439, entitled "Device and Method for Compressing an Edge of a Building Panel and a Building Panel With Compressed Edges", filed Sep. 15, 2006.
Pervan, Darko, et al., U.S. Appl. No. 11/635,674, entitled "Laminate Floor Panels", filed Dec. 8, 2006.
Pervan, Darko, et al., U.S. Appl. No. 11/635,633, entitled "Laminate Floor Panels", filed Dec. 8, 2006.
Hakansson, Niclas, U.S. Appl. No. 11/643,881, entitled "V-Groove", filed Dec. 22, 2006.
Bergelin, Marcus, et al., U.S. Appl. No. 11/649,837, entitled "Resilient Groove", filed Jan. 5, 2007.
Pervan, Darko, et al., U.S. Appl. No. 11/575,600, entitled "Mechanical Locking of Floor Panels with a Flexible Tongue", filed Mar. 20, 2007.
Pervan, Darko, U.S. Appl. No. 11/806,478, entitled "Wear Resistant Surface", filed May 31, 2007.
Pervan, Darko, et al., U.S. Appl. No. 11/770,771, entitled "Locking System Comprising a Combination Lock for Panels", filed Jun. 29, 2007.
Pervan, Darko, et al., U.S. Appl. No. 11/822,699, entitled "Flooring and Method for Laying and Manufacturing the Same," filed Jul. 9, 2007.
Pervan, Darko, U.S. Appl. No. 11/822,690, entitled "Locking System and Flooring Board," filed Jul. 9, 2007.
Pervan, Darko, U.S. Appl. No. 11/822,713, entitled "Locking System and Flooring Board," filed Jul. 9, 2007.
Pervan, Darko, U.S. Appl. No. 11/822,715, entitled "Floorboards, Flooring Systems and Methods for Manufacturing and Installation Thereof," filed Jul. 9, 2007.
Pervan, Darko, U.S. Appl. No. 11/822,714, entitled "Floorboards, Flooring Systems and Methods for Manufacturing and Installation Thereof," filed Jul. 9, 2007.
Pervan, Darko, U.S. Appl. No. 11/822,718, entitled "Floorboards, Flooring Systems and Methods for Manufacturing and Installation Thereof," filed Jul. 9, 2007.
Pervan, Darko, U.S. Appl. No. 11/822,717, entitled "Floorboards, Flooring Systems and Methods for Manufacturing and Installation Thereof," filed Jul. 9, 2007.
Pervan, Darko, U.S. Appl. No. 11/822,719, entitled "Floorboards, Flooring Systems and Methods for Manufacturing and Installation Thereof," filed Jul. 9, 2007.
Pervan, Darko, et al., U.S. Appl. No. 11/822,716, entitled "Flooring and Method for Laying and Manufacturing the Same," filed Jul. 9, 2007.
Pervan, Darko, et al., U.S. Appl. No. 11/822,679, entitled "Flooring and Method for Laying and Manufacturing the Same," filed Jul. 9, 2007.
Pervan, Darko, U.S. Appl. No. 11/822,689, entitled "Flooring Systems and Methods for Installation," filed Jul. 9, 2007.
Pervan, Darko, U.S. Appl. No. 11/822,686, entitled "Floorboard and Method for Manufacturing Thereof," filed Jul. 9, 2007.
Pervan, Darko, U.S. Appl. No. 11/822,687, entitled "Floorboards for Floorings," filed Jul. 9, 2007.
Pervan, Darko, U.S. Appl. No. 11/822,688, entitled "Mechanical Locking System for Floorboards," filed Jul. 9, 2007.
Pervan, Darko, et al., U.S. Appl. No. 11/822,696, entitled "Floorboards with Decorative Grooves," filed Jul. 9, 2007.
Pervan, Darko, et al., U.S. Appl. No. 11/822,697, entitled "Floor Panel with Sealing Means," filed Jul. 9, 2007.
Pervan, Darko, et al., U.S. Appl. No. 11/822,698, entitled "Locking System, Floorboard Comprising Such a Locking System, As Well As Method for Making Floorboards," filed Jul. 9, 2007.
Pervan, Darko, U.S. Appl. No. 11/822,684, entitled "Mechanical Locking System for Floor Panels," filed Jul. 9, 2007.
Pervan, Darko, U.S. Appl. No. 11/822,723, entitled "Mechanical Locking System for Panels and Method of Installing Same," filed Jul. 9, 2007.
Pervan, Darko, U.S. Appl. No. 11/822,692, entitled "Building Panel with Compressed Edges and Method of Making Same," filed Jul. 9, 2007.
Pervan, Darko, et al., U.S. Appl. No. 11/822,681, entitled "Mechanical Locking System for Floor Panels," filed Jul. 9, 2007.
Pervan, Darko, et al. U.S. Appl. No. 11/822,683, entitled "Appliance and Method for Surface Treatment of a Board Shaped Material and Floorboard," filed Jul. 9, 2007.
Pervan, Darko, U.S. Appl. No. 11/822,722, entitled "Floorboard, System and Method for Forming a Flooring, and a Flooring Formed Thereof," filed Jul. 9, 2007.
Pervan, Darko, U.S. Appl. No. 11/822,720, entitled "Floor Covering and Locking System," filed Jul. 9, 2007.
Pervan, Darko, U.S. Appl. No. 11/822,682, entitled "Floor Covering and Locking System," filed Jul. 9, 2007.
Jacobsson, Jan, et al., U.S. Appl. No. 11/822,694, entitled "Device and Method for Compressing an Edge of a Building Panel and a Building Panel with Compressed Edges," filed Jul. 9, 2007.
Pervan, Darko, et al., U.S. Appl. No. 11/822,710, entitled "Locking System Comprising a Combination Lock for Panels," filed Jul. 9, 2007.
Bergelin, Marcus, et al., U.S. Appl. No. 11/822,706, entitled "Resilient Groove," filed Jul. 9, 2007.
Pervan, Darko, U.S. Appl. No. 11/822,707, entitled "Locking System for Floorboards," filed Jul. 9, 2007.
Hakansson, Niclas, U.S. Appl. No. 11/822,709, entitled "V-Groove," filed Jul. 9, 2007.
Jacobsson, Jan, U.S. Appl. No. 11/822,708, entitled "Floor Light," filed Jul. 9, 2007.
Pervan, Darko, et al., U.S. Appl. No. 11/822,711, entitled "Laminate Floor Panels," filed Jul. 9, 2007.
Pervan, Darko, et al., U.S. Appl. No. 11/812,712, entitled "Laminate Floor Panels," filed Jul. 9, 2007.
Pervan, Darko, et al., U.S. Appl. No. 11/775,885, entitled "Mechanical Locking of Floor Panels with a Flexible Bristle Tongue," filed Jul. 11, 2007.
Pervan, Darko, et al., U.S. Appl. No. 11/889,351, entitled "Mechanical Locking of Floor Panels with a Flexible Tongue," filed Aug. 10, 2007.
Pervan, Darko, U.S. Appl. No. 11/839,259, entitled "Locking System and Flooring Board," filed Aug. 15, 2007.

* cited by examiner

PRIOR-ART TECHNIQUE

PRIOR-ART TECHNIQUE

PRIOR-ART TECHNIQUE

Fig. 6b
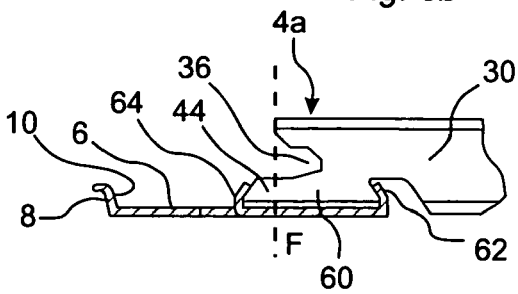
Fig. 5
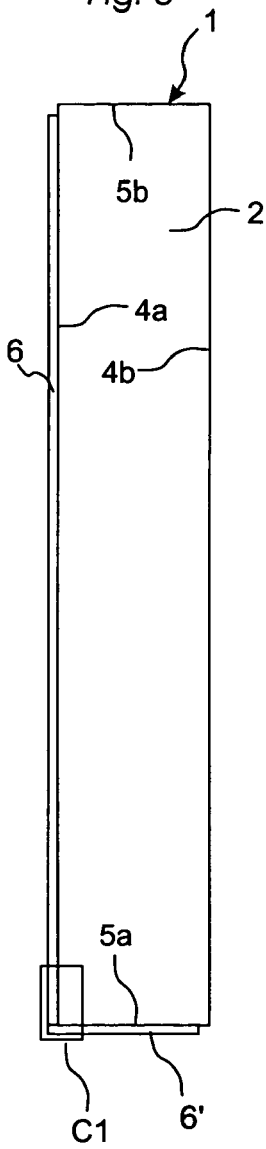
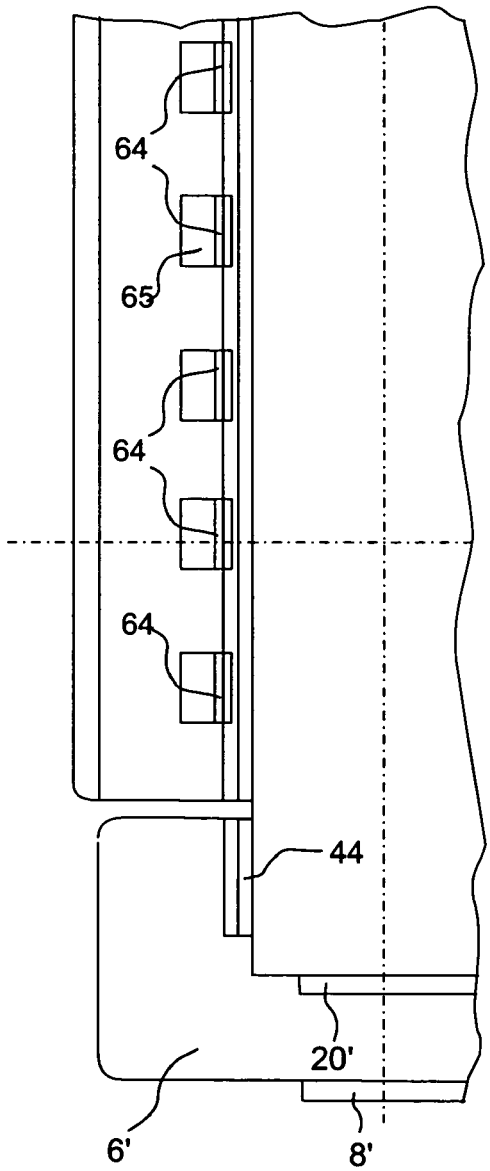
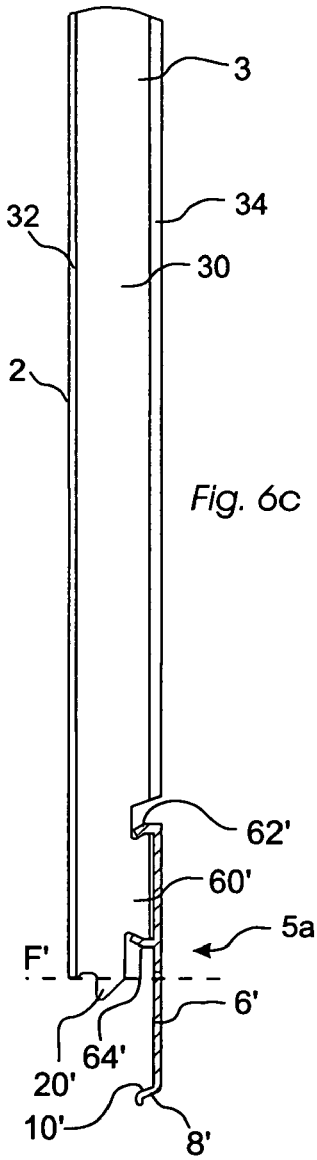
Fig. 6c
Fig. 6a

LOCKING SYSTEM AND FLOORING BOARD

This application is a continuation, of Application No. PCT/SE99/00933, filed May 31, 1999, and which designated the United States of America.

FIELD OF THE INVENTION

The invention generally relates to a locking system for mechanically joining floorboards. More specifically, the invention concerns an improvement of a locking system of the type described and shown in WO 94/26999. The invention also concerns a floorboard provided with such a locking system.

It is known that board material can be joined mechanically and that there are many different types of joining systems. The present invention suggests specifically how a modified tongue-and-groove joint for vertical locking and a joint for horizontal locking can be designed in an optimal manner for both function and cost level to be better than in prior-art designs.

The invention is particularly suited for mechanical joining of thin floating floorboards, such as laminate flooring and parquet flooring, and therefore the following description of prior art and the objects and features of the invention will be directed to this field of application, above all rectangular floorboards which have a wood fibre core having a size of about 1.2*0.2 m and a thickness of about 7 mm and which are intended to be joined along long sides as well as short sides.

BACKGROUND ART

Conventional floorboards are usually joined by means of glued tongue-and-groove joints along their long sides and short sides. In laying, the boards are moved together horizontally, a projecting tongue along the joint edge of a first board being inserted into the groove along the joint edge of a second board. The same method is used for long sides as well as short sides. The tongue and groove are designed merely for such horizontal joining and with special regard to the design of glue pockets and glue surfaces to enable efficient adhesion of the tongue in the groove. The tongue-and-groove joint has cooperating upper and lower abutment surfaces which position the boards vertically to obtain a planar upper surface of the completed floor.

In addition to such conventional floorings that are joined by means of glued tongue-and-groove joints, floorboards have recently been developed which instead are mechanically joined and which do not require the use of glue.

WO 94/26999 discloses a locking system for mechanical joining of building boards, especially floorboards. The boards can be locked by means of this locking system both perpendicular to and in parallel with the principal plane of the boards on long sides as well as short sides. Methods for making such floorboards are disclosed in SE 9604484-7 and SE 9604483-9. The basic principles of designing and laying the floorboards as well as the methods for making the same that are described in the above three documents are applicable also to the present invention, and therefore the contents of these documents are incorporated by reference in the present description.

With a view to facilitating the understanding and the description of the present invention, and the understanding of the problems behind the invention, a brief description of floorboards according to WO 94/26999 follows, reference being made to FIGS. 1-3. This description of the prior-art technique will in applicable parts also be considered to apply to the following description of embodiments of the present invention.

A floorboard 1 of known design is illustrated from below and from above in FIGS. 3*a* and 3*b*, respectively. The board is rectangular with a top side 2, an underside 3, two opposite long sides 4*a*, 4*b* which form joint edges, and two opposite short sides 5*a*, 5*b* which form joint edges.

Both the long sides 4*a*, 4*b* and the short sides 5*a*, 5*b* can be joined mechanically without any glue in the direction D2 in FIG. 1*c*. To this end, the board 1 has a planar strip 6 which is mounted at the factory and which extends along one long side 4*a*, said strip extending along the entire long side 4*a* and being made of a flexible, resilient aluminium sheet. The strip 6 can be mechanically fixed according to the embodiment illustrated, or fixed by means of glue or in some other fashion. Other strip materials can be used, such as sheet of some other metal, and aluminium or plastic sections. Alternatively, the strip 6 can be integrally formed with the board 1, for example by some suitable working of the body of the board 1. However the strip 6 is always integrated with the board 1, i.e. it is not mounted on the board 1 in connection with laying. The width of the strip 6 can be about 30 mm and its thickness about 0.5 mm. A similar, although shorter strip 6' is arranged also along one short side 5*a* of the board 1. The edge side of the strip 4 facing away from the joint edge 4*a* is formed with a locking element 8 extending along the entire strip 6. The locking element 8 has an active locking surface 10 facing the joint edge 4*a* and having a height of, for instance, 0.5 mm. In connection with laying, the locking element 8 cooperates with a locking groove 14, which is formed in the underside 3 of the opposite long side 4*b* of an adjacent board 1'. The short side strip 6' is provided with a corresponding locking element 8' and the opposite short side 5*b* has a corresponding locking groove 14'.

For mechanical joining of long sides as well as short sides also in the vertical direction (direction D1 in FIG. 1*c*), the board 1 is also formed, along one long side 4*a* and one short side 5*a*, with a laterally open recess 16. The recess 16 is defined downwards by the associated strips 6, 6'. At the opposite edges 4*b* and 5*b* there is an upper recess 18 defining a locking tongue 20 cooperating with the recess 16 (see FIG. 2*a*).

FIGS. 1*a*-1*c* show how two such boards 1, 1' can be joined by downwards angling. FIGS. 2*a*-2*c* show how the boards 1, 1' can instead be joined by snap action. The long sides 4*a*, 4*b* can be joined by both methods, whereas the short sides 5*a*, 5*b*'—after laying of the first row—are normally joined after joining of the long sides, and merely by snap action. When a new board 1' and a previously laid board 1 are to be joined along their long sides according to FIGS. 1*a*-1*c*, the long side 4*b* of the new board 1' is pressed against the long side 4*a* of the previously laid board 1 according to FIG. 1*a*, so that the locking tongue 20 is inserted into the recess 16. The board 1' is then angled downwards to the subfloor 12 according to FIG. 1*b*. Now the locking tongue 20 completely enters the recess 16 while at the same time the locking element 8 of the strip 6 enters the locking groove 14. During this downwards angling, the upper part of the locking element 8 can be active and accomplish a guiding of the new board 1' towards the previously laid board 1. In the joined state according to FIG. 1*c*, the boards 1, 1' are locked in both D1 direction and D2 direction, but can be displaced relative to each other in the longitudinal direction of the joint.

FIGS. 2*a*-2*c* illustrate how also the short sides 5*a* and 5*b* of the boards 1, 1' can be mechanically joined in both D1 and D2 direction by the new board 1' being moved essentially horizontally towards the previously laid board 1. This can be carried out after the long side 4*b* of the new board 1' has been joined as described above. In the first step in FIG. 2*a*, bevelled surfaces adjacent to the recess 16 and the locking tongue 20 cooperate so that the strip 6' is forced downwards as a direct consequence of the joining of the short sides 5*a*, 5*b*. During the final joining, the strip 6' snaps upwards as the locking element 8' enters the locking groove 14'. By repeating the operations shown in FIGS. 1 and 2, the laying of the entire floor can be made without glue and along all joint edges. Thus, prior-art floorboards of the above-mentioned type are mechanically joined by, as a rule, first being angled downwards on the long side, and when the long side is locked, the short sides are snapped together by horizontal displacement along the long side. The boards 1, 1' can be taken up again in reverse order, without damaging the joint, and be laid once more.

In order to function optimally, the boards, after being joined, should along their long sides be able to take a position where there is a possibility of a small play between the locking surface 10 and the locking groove 14. For a more detailed description of this play, reference is made to WO 94/26999.

In addition to the disclosure of the above-mentioned patent specifications, Norske Skog Flooring AS (licensee of Valinge Aluminium AB) introduced a laminate flooring with a mechanical joining system according to WO 94/26999 in January 1996 in connection with the Domotex fair in Hannover, Germany. This laminate flooring marketed under the trademark Alloc® is 7.6 mm thick, has a 0.6 mm aluminium strip 6 which is mechanically fixed on the tongue side and the active locking surface 10 of the locking element 8 has an inclination of about 80° to the plane of the board. The vertical joint is formed as a modified tongue-and-groove joint, where the term "modified" relates to the possibility of joining groove and tongue by inwards angling.

WO 97/47834 (Unilin) discloses a mechanical joining system which is essentially based on the above prior-art principles. In the corresponding product which this applicant has begun to market in the latter part of 1997, biasing between the boards is strived for. This leads to high friction and difficulties in angling together and displacing the boards. The document shows a plurality of embodiments of the locking system.

Other prior-art locking systems for mechanical joining of board material are disclosed in GB 2,256,023, which shows one-sided mechanical joining for the provision of an expansion joint, and in U.S. Pat. No. 4,426,820, which shows a mechanical locking system which, however, does not allow displacement and locking of short sides by snap action.

SUMMARY OF THE INVENTION

Although the flooring according to WO 94/26999 and the flooring marketed under the trademark Alloc® have great advantages compared with conventional, glued floors, additional improvements are desirable. There are today no known products or methods which result in sufficiently good solutions to the problems, requirements and desiderata stated below and related to (i) manufacture of floorboards with mechanical locking systems of the type stated, (ii) handling and laying of such floorboards, and (iii) properties of a finished, joined floor prepared from such floorboards.

(i) Manufacture

In connection with the manufacture of the floorboards, the following problems, requirements and desiderata exist:

1. It is known that angling-together of the floorboards can be carried out with a tongue whose lower front part follows a circular arc. If this lower front part of the tongue should constitute a lower abutment surface against the groove in the joined state, the lower abutment surface of the groove must be made with a corresponding arcuate shape to fit the tongue in the locked position. This solution suffers from the drawback that it requires the making of arcuate surfaces and, consequently, a very accurate adjustment of the wood-working tools both vertically and horizontally.
2. From the viewpoint of manufacture it is desirable for the abutment surfaces of the groove which are to cooperate with the abutment surfaces of the tongue to be planar and parallel with the floor surface since narrow tolerances for the abutment surfaces of the tongue-and-groove joint (a few hundredth parts of a mm) can then be obtained without a critical horizontal adjustment of the wood-working tools being necessary for the forming of tongue and groove.
3. The manufacture is facilitated if there are as many degrees of freedom as possible in respect of tolerances of manufacture. It is therefore desirable that the number of critical abutment and guide surfaces be limited as much as possible without lowering the standards of perfect quality in the joined state with small joint gaps and limited vertical difference (in the order of 0.1 mm) and excellent function in the angling upwards and downwards in connection with laying and removal.
4. To make it possible to form the groove by means of horizontally operating wood-working tools in the case where the projecting portion is made in one piece with the body of the board, it is a great advantage if the locking element of the projecting portion is positioned under the lower abutment surface of the groove or on a level therewith. The working tools can then be inserted horizontally towards the joint edge above the locking element.
5. To achieve less waste of material when machining the boards for making the locking system, it is advantageous if the tongue projects to a minimum extent in the horizontal direction outside the joint edge. The bigger the tongue, the more material must be removed above and below the tongue.

(ii) Handling/Laying

In connection with handling and laying of the floorboards, the following problems, requirements and desiderata exist:

1. It must be possible to join the long sides of the boards by angling together about the upper joint edges of the boards. In the angling together, it must be possible to insert the tongue in the groove, which necessitates a modification of the design of conventional, glued tongue-and-groove joints which only need to be pushed together horizontally.
2. It should be possible to carry out the inwards angling so that the vertical fit between tongue and groove can occur with maximum accuracy or tolerance to obtain good vertical locking of the completed floor. With prior-art tongue-and-groove joints it is difficult to satisfy such a requirement for a good fit in the joined state and at the same time achieve an optimal function in the inwards angling.
3. For easy laying without any undesired resistance, it is at the same time a wish that the tongue need not be pressed or forced into the groove during the angling movement.
4. Known mechanical locking systems suffer from drawbacks relating to the undesired possibility of backwards angling, i.e. the possibility of turning two joined boards relative to each other and downwards about the joint edge, i.e. past the horizontal position. In the above prior-art flooring in FIGS. 1-3, it is only the rigidity of the aluminium strip that restricts the possibility of backwards angling. When a user handles the boards it would be advantageous if backwards angling was made difficult or could be prevented since it would then not be possible for consumers to open the boards in an incorrect manner in connection with testing and thus damage or bend the projecting portion, i.e. the aluminium strip in FIGS. 1-3. A solution where the strip is made more rigid is in opposition to the requirement that the strip must be bendable and resilient to achieve a good snap-in function.

5. If it should also be possible to take up the locking system, generally the same requirements and desiderata for upwards angling are applicable as for downwards angling.

(iii) Properties of the Joined Floor

For the completed, joined floor the following problems, requirements and desiderata exist:

1. With a view to preventing undesirable vertical displacement between the joint edges of the boards of the completed floor, there should be a close vertical fit between tongue and groove.
2. Curved abutment surfaces constitute a disadvantage not only from the viewpoint of manufacture. A high horizontal tension load on the joint, which may arise especially owing to shrinkage at low relative humidity, can in combination with curved abutment surfaces of the tongue-and-groove joint cause undesirable vertical displacement and/or undesirable vertical play if the tension load causes the boards to slide away somewhat from each other. It is therefore desirable for the abutment surfaces of the groove that are to cooperate with the abutment surfaces of the tongue to be planar and parallel with the floor surface.
3. Also for the completed floor it is preferable to counteract or prevent backwards angling of the floorboards about the joint edges. When a completed floor swells in summer, it is possible—if the possibility of backwards angling is prevented—to counteract rising of the floorboards. This is particularly important for large floors with a considerable degree of load and swelling.
4. The depth of the groove should be minimised since drying in winter may cause what is referred to as edge rising if the groove is weakened by being milled out to a great extent, i.e. by having a great depth. This wish for a limited depth of the groove is particularly important for mechanically joined floors where the edges are not held together by means of glue.

Known vertical and horizontal joints for mechanically joined floorboards do not satisfy the above-identified requirements, problems and desiderata and are therefore not optimal in respect of function and production cost.

The general problem and the object of the invention thus are to provide a mechanical locking system of the type described above, which permits inwards angling from above, which counteracts backwards angling and which yields an exact fit between tongue and groove, while at the same time the manufacture can be optimised in respect of accuracy, number of critical parameters and costs of material.

Summing up, there is a great demand for providing a locking system of the type stated above which to a greater extent than prior art takes the above-mentioned requirements, problems and desiderata in consideration. An object of the invention is to satisfy this demand.

These and other objects of the invention are achieved by a locking system and a floorboard which have the features stated in the independent claims, preferred embodiments being defined in the dependent claims.

The invention is based on the understanding that with prior-art locking systems it is difficult to solve all the above problems and desiderata at the same time, which means that a modification of the locking systems is necessary. The invention is specifically based on the understanding that essentially all the above-mentioned requirements, problems and desiderata can be satisfied if the known tongue-and-groove joint is modified in a special manner. When developing mechanical locking systems, one has traditionally started from the design of the glued tongue-and-groove joint. From this starting point, the known vertical joint has then been supplemented with a horizontal lock and the tongue-and-groove joint has been modified so that inwards angling can more easily be carried out from above. However, what has not been taken into consideration in this development is that in a mechanical system it is not necessary to be able to glue tongue and groove together in an efficient way. Since gluing is not necessary, there is free scope for modifications of the known tongue-and-groove joint. Free scope for modifications is also allowed by the fact that known glued tongue-and-groove joints also serve to ensure horizontal joining (by means of glue), which requirement does not exist in mechanical locking systems of the type to which the invention is directed.

According to a first aspect of the invention, a locking system is provided for mechanical joining of floorboards, said locking system comprising a tongue-and-groove joint, the groove and tongue of which have cooperating upper abutment surfaces and cooperating lower abutment surfaces for vertical locking of two joint edges of two adjacent floorboards, said upper and lower abutment surfaces being essentially parallel with the principal plane of the floorboards, and said locking system comprising, for horizontal mechanical joining of the joint edges perpendicular to the same, a locking groove formed in the underside of a first one of the joint edges and extended in parallel therewith, and a portion projecting from the second joint edge and integrated with a body of the floorboard, said portion supporting, at a distance from the joint edge, a locking element cooperating with the locking groove, wherein said tongue is anglable into the groove, and wherein said locking element is insertable into the locking groove by a mutual angular motion of the boards about the joint edges. The locking system according to the invention is characterised in that, in the joined state, the cooperating upper abutment surfaces are limited horizontally inwards from the joint edge and horizontally outwards to the joint edge by an inner vertical plane and an outer vertical plane, respectively;

that the tongue-and-groove joint is so designed that there is in the groove, in the joined state, between the inner vertical plane and the outer vertical plane and below the tongue, a space which extends horizontally from the inner vertical plane and at least halfway to the outer vertical plane;

that the tongue-and-groove joint is further so designed that the boards, during a final phase of the inwards angling when the locking element is inserted into the locking groove, can take a position where there is a space in the groove between the inner and the outer vertical plane and below the tongue; and that the lower abutment surfaces are positioned essentially outside the outer vertical plane.

By the expression "cooperating abutment surfaces" is meant surfaces of tongue and groove which in the joined state of the floorboards either engage each other directly in the vertical direction or at least are in such immediate vicinity of each other in the vertical direction that they can be made to contact each other to pre-vent the boards from being relatively offset in the vertical direction. Thus, within the scope of the invention there can especially be horizontal surfaces of both the tongue and the groove which do not form any "cooperating abutment surface", but which can have some other specific function.

In a conventional tongue-and-groove joint, both upper and lower abutment surfaces are, as a rule, located in the inner part of the groove. With planar abutment surfaces in the inner part of the groove, it is not possible to achieve a good fit as well as optimal inwards angling. If tongue and groove are equilaterally designed on the upper and lower side, the floorboards are just as easy to angle upwards as downwards/backwards.

A locking system according to the invention, however, can exhibit, both during the final inwards angling and in the joined state, a space in the groove under the tongue. Thanks to this space, the tongue can unimpededly be angled into the groove when two boards are joined by being angled together. Moreover, the locking system can be so designed that the angling together can take place while the boards are held in mutual contact at the upper corner portions of the adjacent joint edges. Despite the provision of this space in the groove under the tongue, it is according to the invention possible to achieve an exact vertical fit between tongue and groove in the joined state thanks to the fact that the lower abutment surfaces are, at least in large part, horizontally displaced outside the upper abutment surfaces.

The present invention solves, at the same time, the problem of undesirable backwards angling of the boards thanks to the lower abutment surfaces being displaced relative to the upper abutment surfaces in the direction of the locking element. In the known locking systems, it is only the rigidity of the projecting portion that limits the backwards angling. In the invention, however, said displacement accomplishes an angular limitation of the movement of the tongue that effectively counteracts any angling of the tongue past its intended position in the groove, i.e. that counteracts backwards angling of the boards.

The invention also presents the advantage that manufacture can be carried out with working tools which operate only in the plane of the floorboards, thanks to the fact that no curved surfaces are necessary in the tongue-and-groove joint. The tolerances of the vertical fit can thus be made considerably better. The space in the groove under the tongue thus solves not only a problem relating to inwards angling, but also solves the problem of achieving an exact vertical fit between the boards. Thus the space has a function both during the inwards angling and in the joined state.

Moreover the use of essentially plane-parallel abutment surfaces in the tongue-and-groove joint means avoiding the above-mentioned problems with vertical displacement and/or play caused by any horizontal tension load on the joint. Completely planar, horizontal surfaces are ideal, but there should be a possibility of implementing the invention with surfaces that marginally deviate from this ideal design.

To sum up, the present invention provides a locking system for mechanical joining, which permits inwards angling from above, counteracts backwards angling and yields an exact fit between tongue and groove. Inwards angling can be carried out without any vertical play between tongue and groove and without necessitating opening of the groove when the tongue is pressed in. The depth of the tongue and groove does not affect the possibility of inwards angling and the fit between tongue and groove or the relative position of the floorboards. Backwards angling is counteracted, and the groove can be manufactured rationally by means of horizontally operating tools which also permit manufacture of the locking device in a machined wood fibre strip.

In a preferred embodiment, the space in the groove under the tongue, in the joined state, is horizontally extended essentially all the way from the outer vertical plane to the inner vertical plane. Thus, in this embodiment there is in the joined state a space over essentially the entire horizontal range in the groove, within which the cooperating upper abutment surfaces are extended. In this embodiment, essentially no part of the lower abutment surfaces are positioned inside the outer vertical plane. In theory, this embodiment would be the most ideal one since the vertical fit between tongue and groove can then be optimised while at the same time the tongue can unimpededly be inserted into the groove. However, within the scope of the invention, there is a possibility of the lower abutment surfaces extending somewhat inwards in a direction towards the bottom of the groove past the outer vertical plane.

The space under the tongue can be limited downwards by a planar, horizontal surface of the groove, whose extension to the edge joint forms the lower abutment surface of the groove, or by a groove surface which is inclined to the horizontal plane or arcuate, or a combination of a planar surface and an inclined/arcuate surface of the groove.

Generally, the space in the groove under the tongue can be formed by the tongue being bevelled/cut away, or by the groove being hollowed out.

In an embodiment which is preferred in respect of horizontal tolerances in manufacture, the groove has in the joined state an upper and a lower horizontal surface, which constitute inwardly directed extensions of the upper abutment surface and the lower abutment surface, respectively, of the groove, and there is also an inner horizontal play between the bottom of the groove and the tip of the tongue. Owing to the inwardly directed extensions of the abutment surfaces of the groove as well as the play between the groove and the tongue at the bottom of the groove, working of tongue and groove in the horizontal direction can be carried out without strict tolerance requirements in the horizontal direction while at the same time it is possible to ensure both an exact vertical fit of the boards and unimpeded inwards angling.

According to the invention, the projecting portion is integrated with a body of the board. The term "integrated" should be considered to comprise (i) cases where the projecting portion is made of a separate component integrally connected with the body at the factory, (ii) cases where the projecting portion is formed in one piece with the body, and (iii) a combination of (i) and (ii), i.e. cases where the inner part of the projecting portion is formed in one piece with the body and its outer part consists of a separate factory-mounted component.

According to a second aspect of the invention, a floorboard is provided, having a locking system according to the invention, on at least two opposite sides and preferably on all four sides to permit joining of all sides of the floorboards.

These and other advantages of the invention and preferred embodiments will appear from the following description and are defined in the appended claims.

Different aspects of the invention will now be described in more detail by way of examples with reference to the accompanying drawings. Those parts of the inventive board which have equivalents in the prior-art board in FIGS. 1-3 are provided with the same reference numerals.

BRIEF DESCRIPTION OF THE DRAWINGS

FIG. 5 is a top plan view of a floorboard according to FIG. 4.

FIG. 6*a* shows on a larger scale a broken-away corner portion C1 of the board in FIG. 5, and FIGS. 6*b* and 6*c* illustrate vertical sections of the joint edges along the long side 4*a* and the short side 5*a* of the board in FIG. 5, from which it specifically appears that the long side and the short side are different.

DESCRIPTION OF PREFERRED EMBODIMENTS

Figure 4:
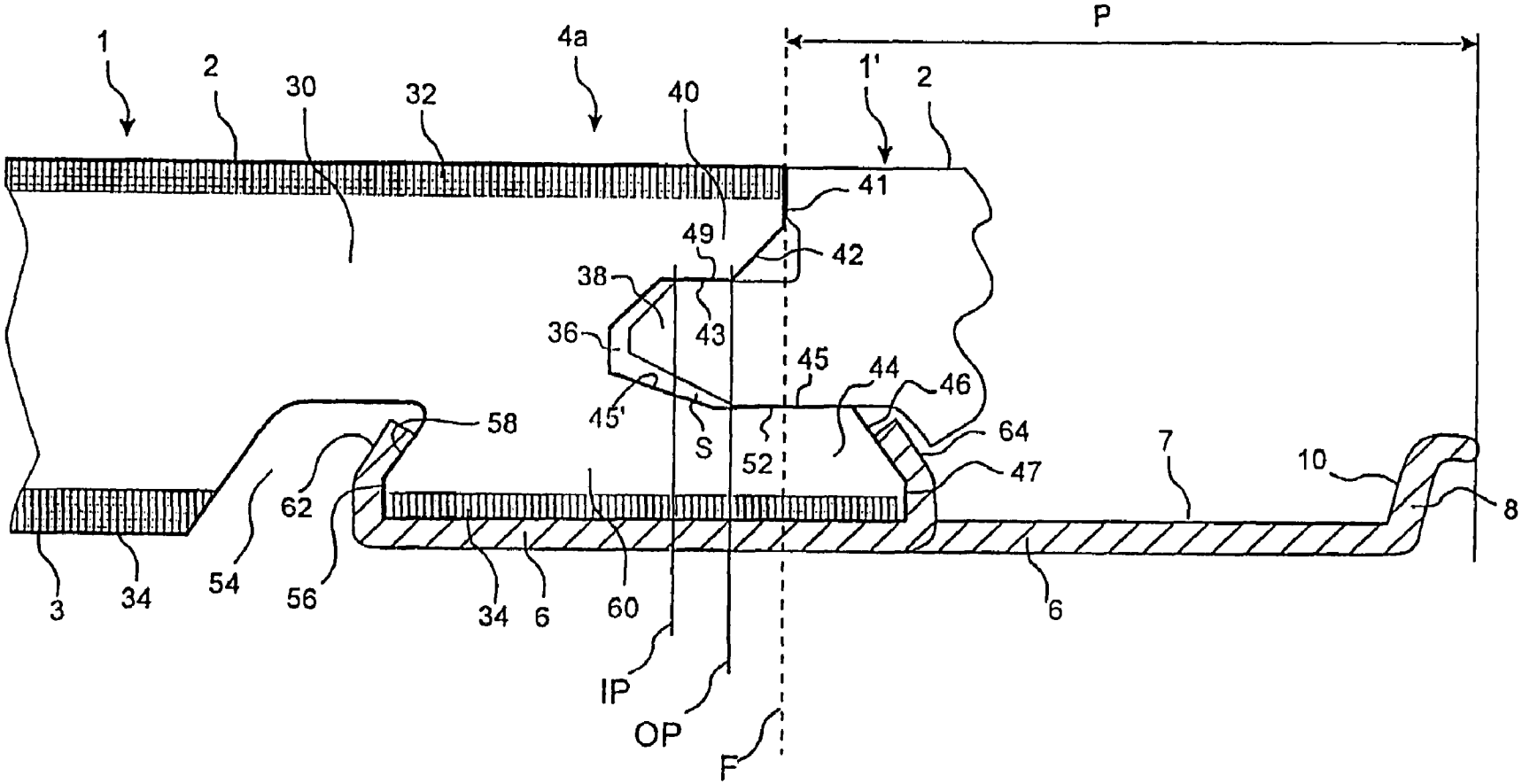
FIG. 4 shows a floorboard with a locking system according to a first embodiment of the invention, an adjacent floorboard being broken away.

A first preferred embodiment of a floorboard 1 provided with a locking system according to the invention will now be described with reference to FIGS. 4-7. FIG. 4 is a sectional view of a long side 4*a* of the board 1, and also part of a long side 4*b* of an adjacent board 1. The body of the board 1 consists of a core 30 of, for instance, wood fibre, which supports a top laminate 32 on its front side and a balance layer 34 on its rear side. The board body 30-34 is rectangular with long sides 4*a*, 4*b* and short sides 5*a*, 5*b*. A separate strip 6 with a formed locking element 8 is mounted at the factory on the body 30-34, so that the strip 6 constitutes an integrated part of the completed floorboard 1. In the Example shown, the strip 6 is made of resilient aluminium sheet. As an illustrative, non-limiting example, the aluminium sheet can have a thickness in the order of 0.6 mm and the floorboard a thickness in the order of 7 mm. For additional description of dimensions, possible materials, etc. for the strip 6, reference is made to the above description of the prior-art board.

The strip 6 is formed with a locking element 8, whose active locking surface 10 cooperates with a locking groove 14 in the opposite joint edge 4*b* of the adjacent board 1' for horizontal interlocking of the boards 1, 1' transversely of the joint edge (D2).

For the forming of a vertical lock in the D1 direction, the joint edge 4*a* has a laterally open groove 36 and the opposite joint edge 4*b* has a laterally projecting tongue 38 (corresponding to the locking tongue 20), which in the joined state is received in the groove 36. The free surface of the upper part 40 of the groove 36 has a vertical upper portion 41, a bevelled portion 42 and an upper planar, horizontal abutment surface 43 for the tongue 38. The free surface of the lower part 44 of the groove 36 has a lower inclined surface 45', a lower planar, horizontal abutment surface 45 for the tongue 38, a bevelled portion 46 and a lower vertical portion 47. The opposite joint edge 4*b* (see FIG. 7*a*) has an upper vertical portion 48, and the tongue 38 has an upper planar, horizontal abutment surface 49, an upper bevelled portion 50, a lower bevelled portion 51 and a lower planar, horizontal abutment surface 52. In the joined state according to FIGS. 4, 7*c* and 8*c*, the boards 1, 1' are locked relative to each other in the vertical direction D1. An upwards movement of the board 1' is counteracted by engagement between the upper abutment surfaces 43 and 49 while a downwards movement of the board 1' is counteracted on the one hand by engagement between the lower abutment surfaces 45 and 52 and, on the other hand, by the board 1' resting on a lower surface portion 7 of the strip 6.

In the joined state, the two juxtaposed upper portions 41 and 48 define a vertical joint plane F. In the Figures, an inner vertical plane IP and an outer vertical plane OP are indicated. The inner vertical plane IP is defined by the inner boundary line of the upper abutment surfaces 43, 49 while the outer vertical plane OP is defined by the outer boundary line of the upper abutment surfaces 43, 49.

As is evident from FIG. 4, the lower part 44 of the groove 36 is extended a distance outside the joint plane F. The lower planar, horizontal abutment surface 45 of the groove 36 thus is positioned partially inside and partially outside the joint plane F while the upper abutment surface 43 of the groove 36 is positioned completely inside and at a distance from the joint plane F. More specifically, the upper abutment surface 43 of the groove 36 is in its entirety positioned between the vertical planes IP and OP while the lower abutment surface 45 of the groove 36 is in its entirety positioned outside the vertical plane OP and extends partially outside the joint plane F. The significance of these circumstances will be described below.

The joint edge 4*a* is in its underside formed with a continuous mounting groove 54 having a vertical lower gripping edge 56 and an inclined gripping edge 58. The gripping edges formed of the surfaces 46, 47, 56, 58 together define a fixing shoulder 60 for mechanical fixing of the strip 6. The fixing is carried out according to the same principle as in the prior-art board and can be carried out with the methods described in the above documents. A continuous lip 62 of the strip 6 is thus bent round the gripping edges 56, 58 of the groove 54 while a plurality of punched tongues 64 are bent round the surfaces 46, 47 of the projecting portion 44. The tongues 64 and the associated punched holes 65 are shown in the broken-away view in FIG. 6*a*.

Figure 1A:
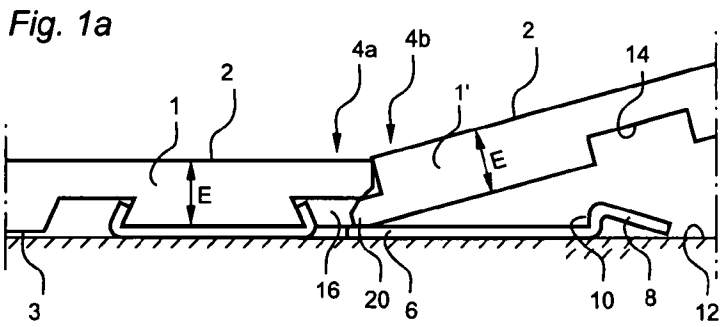
FIGS. 1*a-c* show in three steps a downwards angling method for mechanical joining of long sides of floorboards according to WO 94/026999.
Figure 1B:
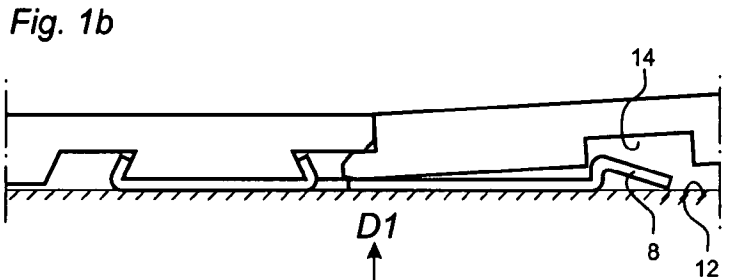
Figure 1C:
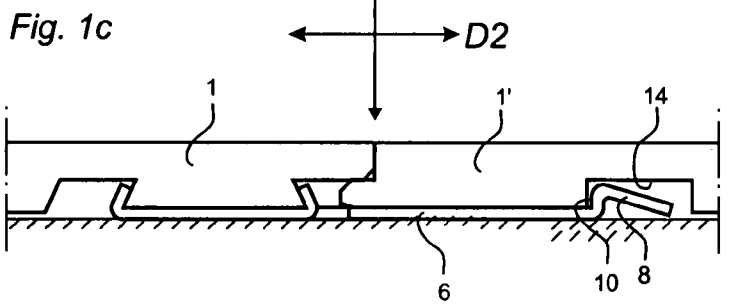
Figure 7A:
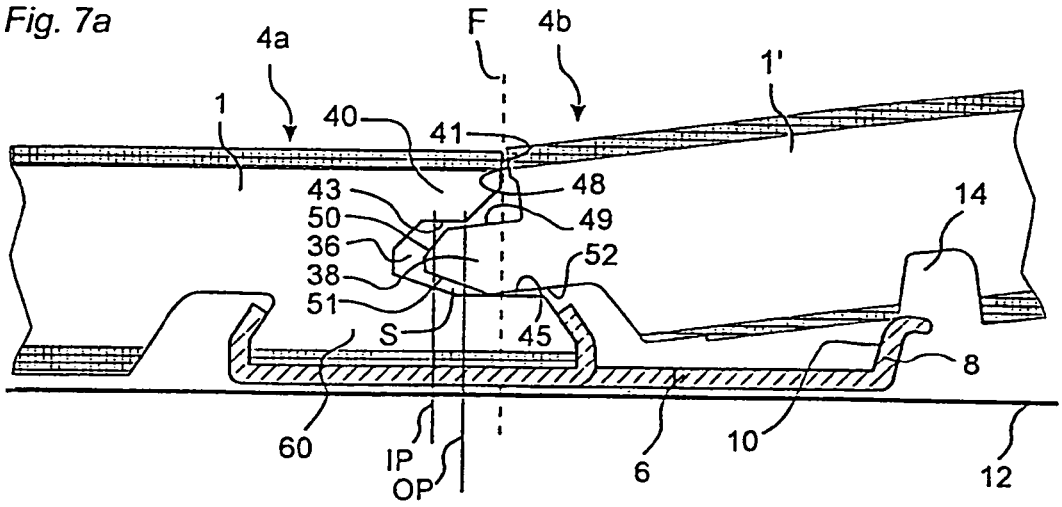
FIGS. 7*a-c* illustrate a downwards angling method for mechanical joining of long sides of the floorboard according to FIGS. 4-6.
Figure 7B:
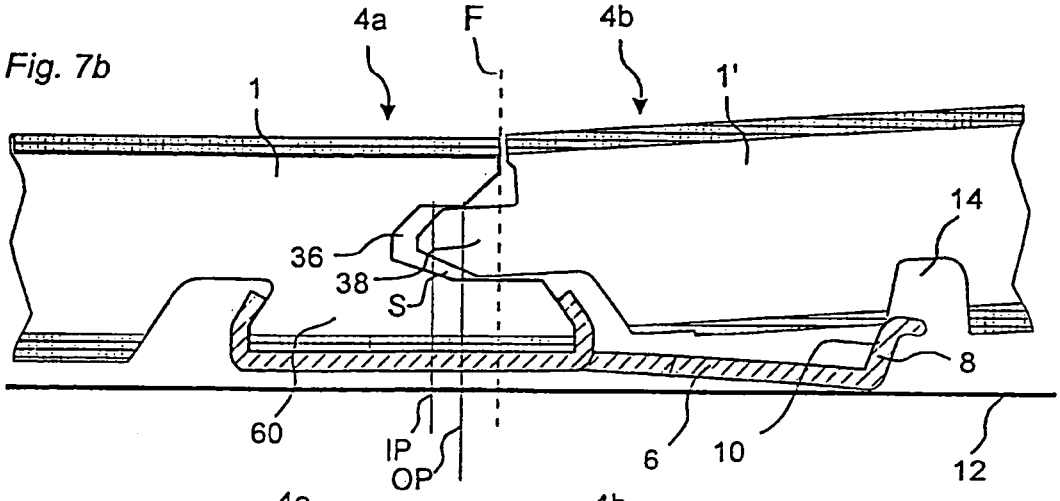
Figure 7C:
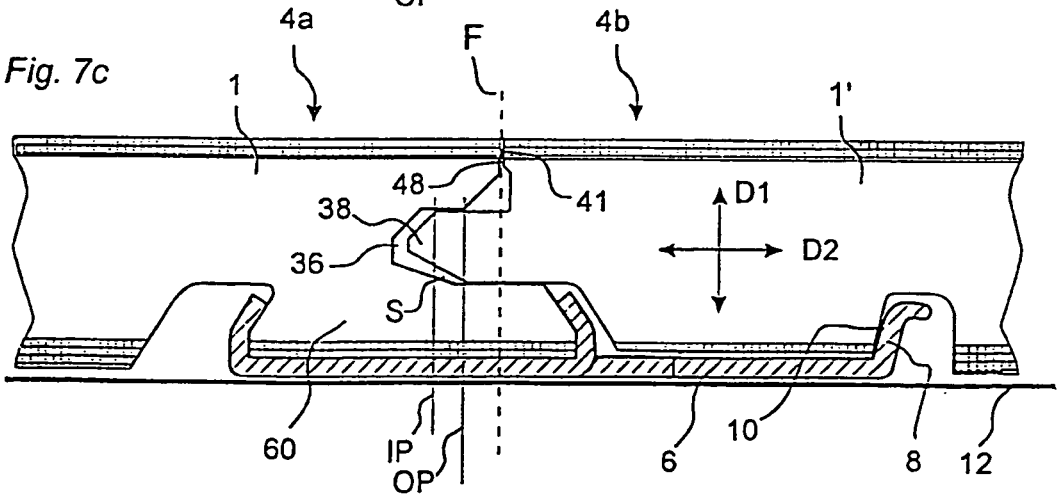

Reference is now made to FIGS. 7*a-c*. The angling together of the long sides 4*a*, 4*b* can be carried out according to the same principle as in FIGS. 1*a-c*. In this context, a small downwards bending of the strip 6 can generally be carried out—not only for this embodiment—as shown in the laying sequence in FIGS. 7*a-c*. This downwards bending of the strip 6 together with an inclination of the locking element 8 makes it possible for the boards 1, 1' to be angled downwards and upwards again with very tight joint edges at the upper surfaces 41 and 48. The locking element 8 should preferably have a high guiding capability so that the boards in connection with downwards angling are pushed towards the joint edge. The locking element 8 should have a large guiding part. For optimal function, the boards, after being joined and along their long sides 4*a*, 4*b*, should be able to take a position where there is a small play between locking element and locking groove, which need not be greater than 0.02-0.05 mm. This play permits displacement and bridges width tolerances. The friction in the joint should be low.

Figure 2A:
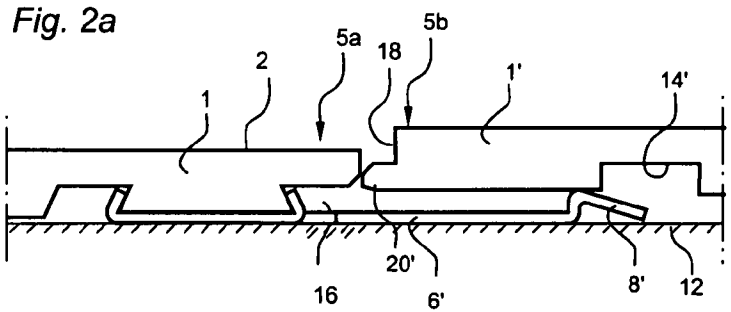
FIGS. 2*a-c* show in three steps a snap-in method for mechanical joining of short sides of floorboards according to WO 94/26999.
Figure 2B:
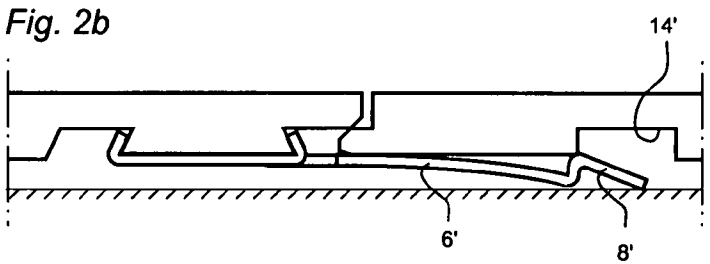
Figure 2C:
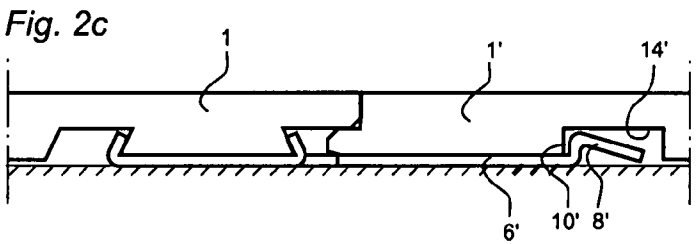
Figure 3A:
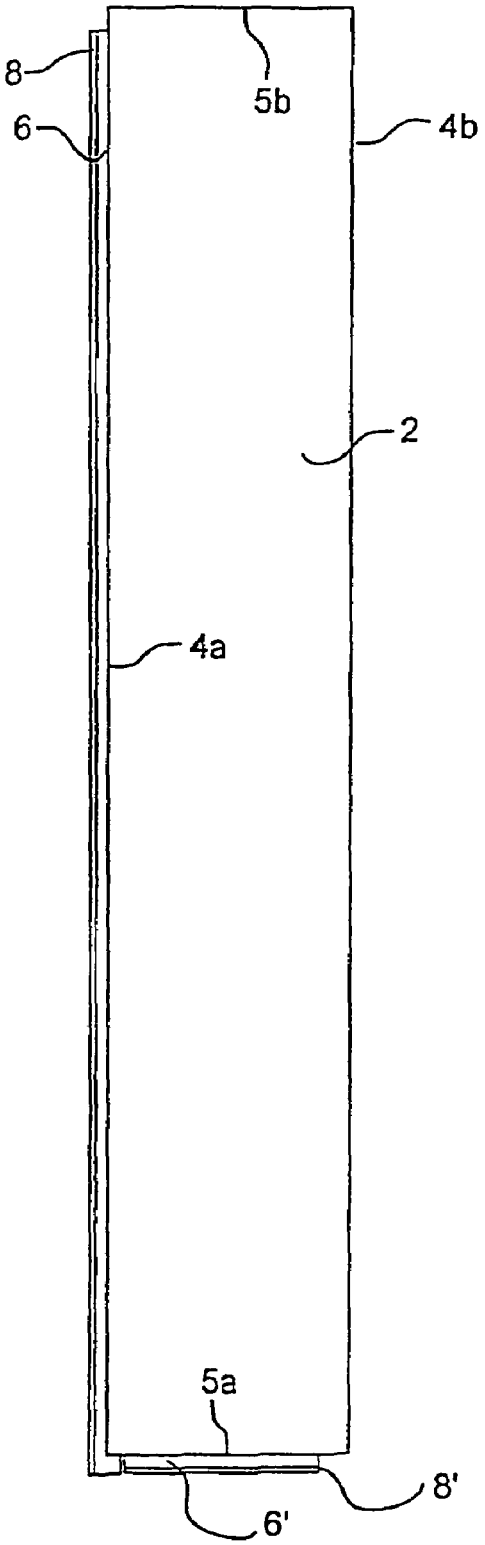
FIGS. 3*a* and 3*b* illustrate a floorboard according to WO 94/26999 seen from above and from below, respectively.
Figure 3B:
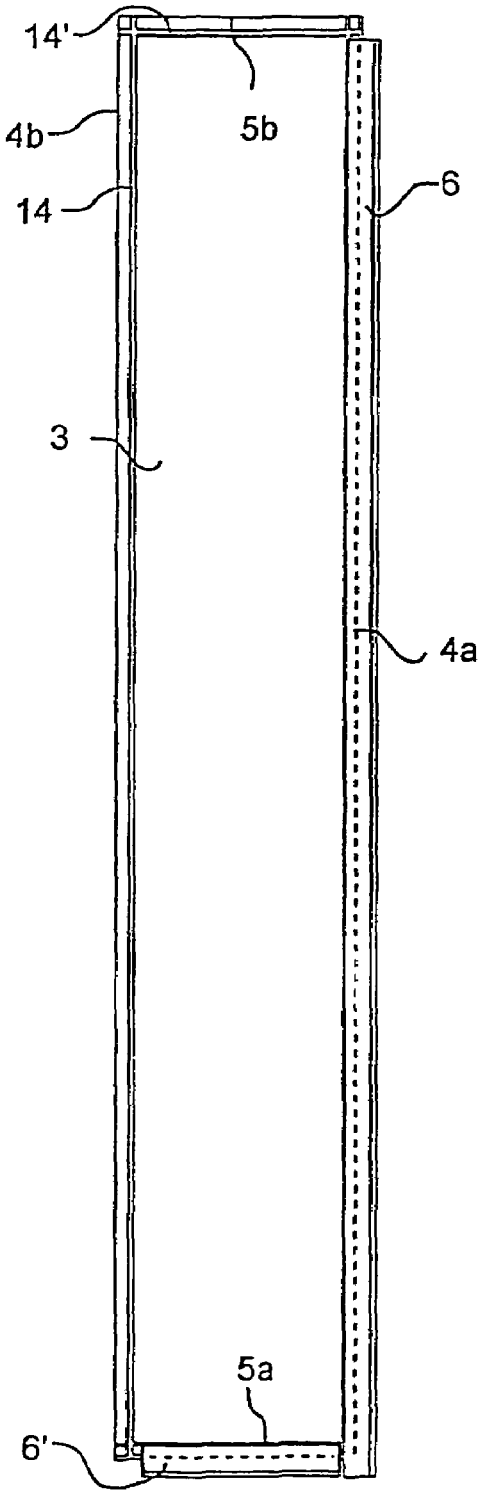
Figure 8A:
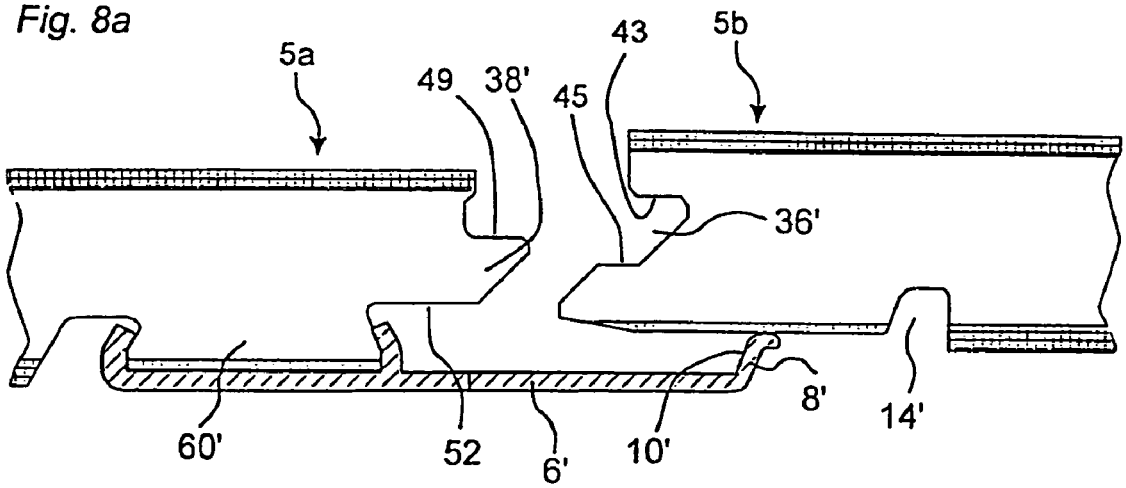
FIGS. 8*a-c* illustrate a snap-in method for mechanical joining of short sides of the floorboard according to FIGS. 4-6.
Figure 8B:
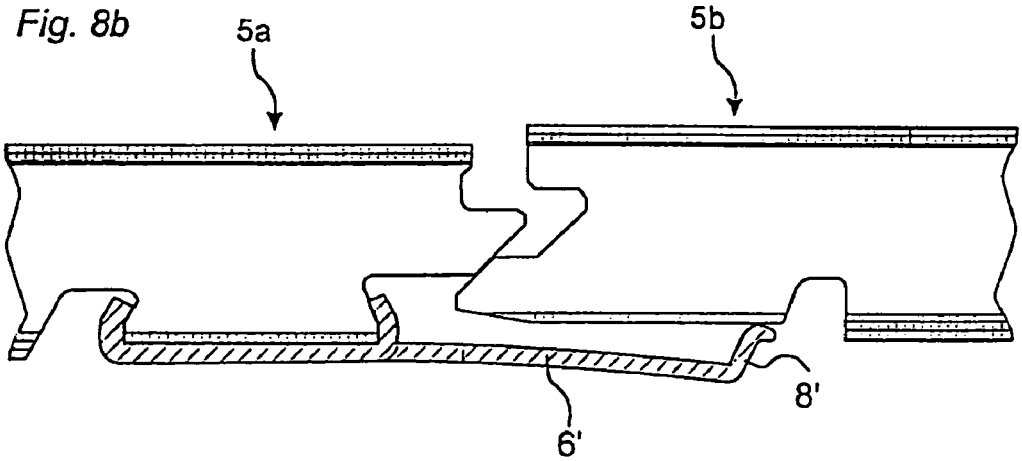
Figure 8C:
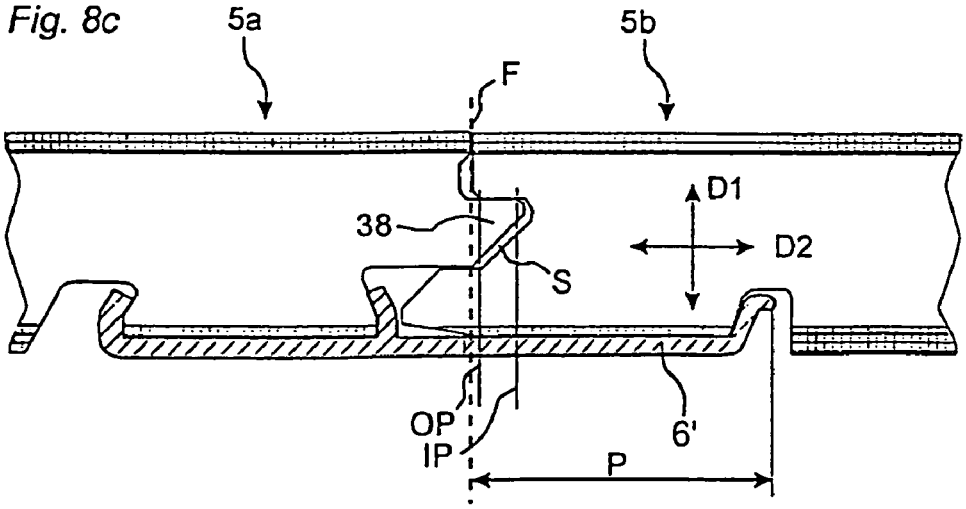

FIGS. 8*a-c* illustrate that snapping together of the short sides 5*a*, 5*b* can be carried out according to the same principle as in FIGS. 2*a-c*. However, the locking system on the short sides in this embodiment is designed differently from the long sides and is specifically adapted for snapping in by vertical displacement and downwards bending of the strip. One difference is that the projecting portion P—here in the form of an aluminium strip 6'—on the short sides 5*a*, 5*b* is arranged on the same joint edge 5*a* as the tongue 38' while the locking groove 14' is formed in the same joint edge 5*b* as the groove 36. A further difference is that the locking element 8' on the short sides is somewhat lower than the locking element 8 on the long sides. In this embodiment, it is bevelled undersides of the tongue and groove which cooperate to obtain this vertical displacement and snapping in. Moreover, it may be particularly noted that the embodiment in FIGS. 8*a-c* in fact has double tongue-and-groove joints, one tongue and one groove on each joint edge, both joints being designed according to the invention with displaced upper and lower abutment surfaces.

Figure 9:
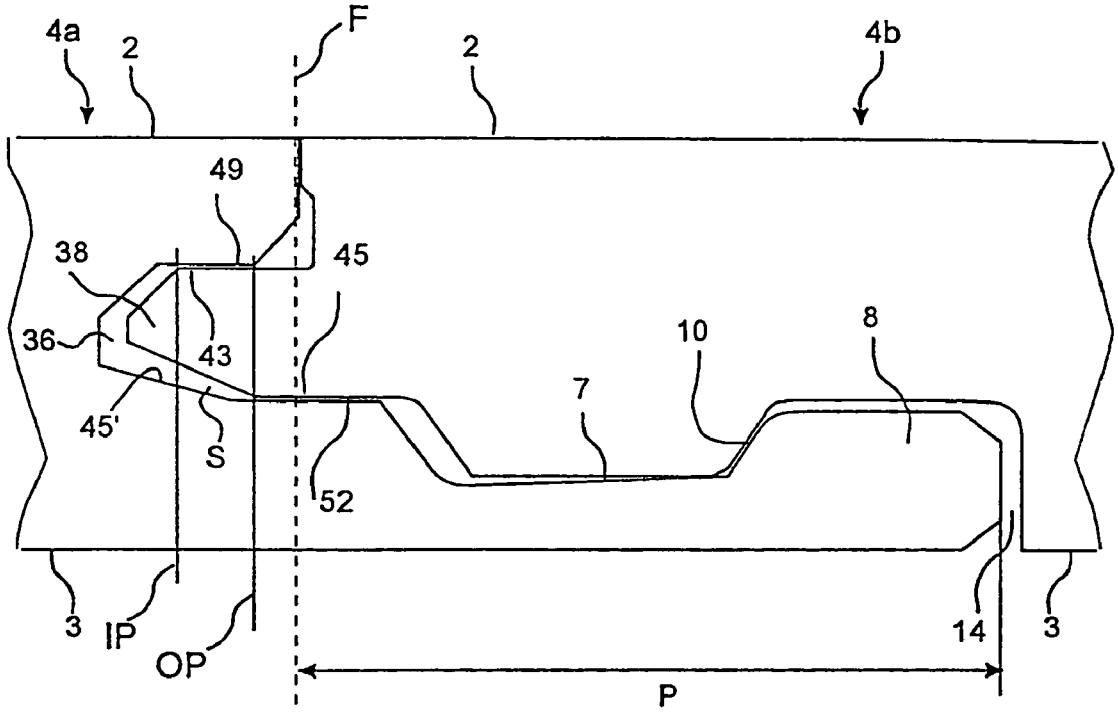
FIG. 9 illustrates a floorboard with a locking system according to a second embodiment of the invention.

FIG. 9 shows a second embodiment of a locking system according to the invention. In contrast to the embodiment in FIGS. 4-8, the projecting portion P is formed, by machining, in one piece with the body of the board 1. The body can be composed of the same materials as in the previous embodiment. In FIG. 9, the vertical planes IP, OP and F are also indicated according to the previous definition. Like in the preceding embodiment, the lower abutment surfaces 45, 52 are entirely displaced outside the outer vertical plane OP.

Figure 10A:
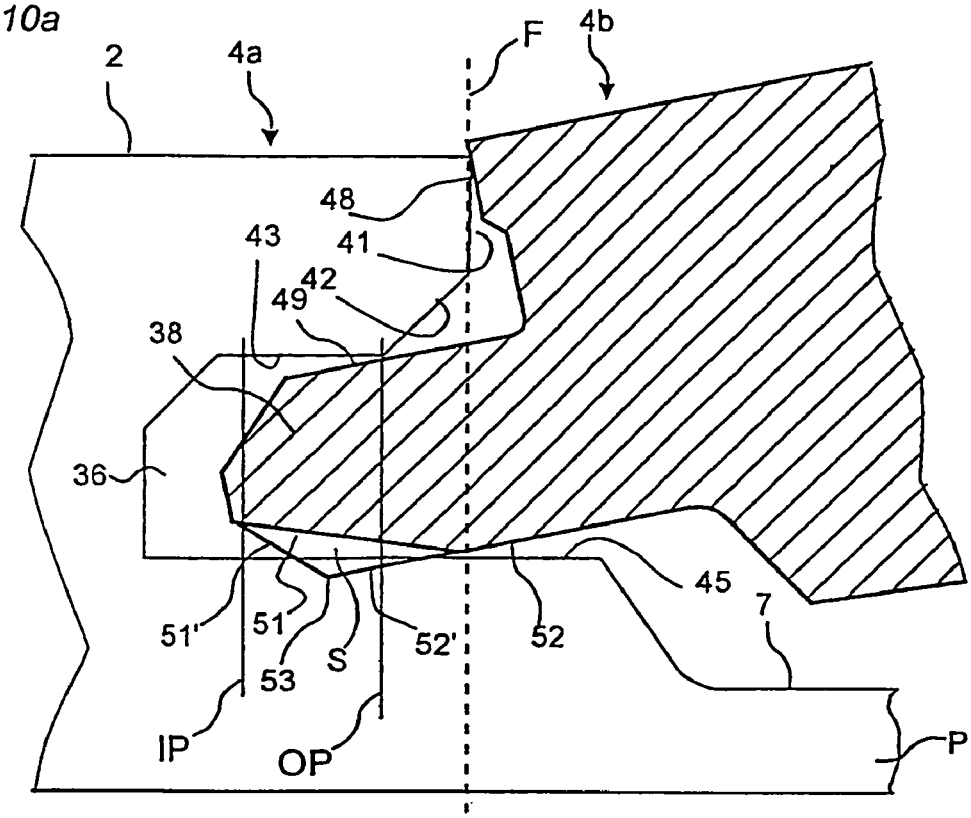
FIGS. 10*a* and 10*b* illustrate on a larger scale broken away details corresponding to FIG. 9 and the importance of a space in the inner part of the groove during inwards angling and in the joined state, respectively.

FIG. 10*a* shows on a larger scale how a downwards angling of the tongue 38 in the embodiment in FIG. 9 has already begun. As described above, the tongue 38 is in its lower part defined by a planar abutment surface 52 and a bevelled portion 51. The groove 36 in FIG. 9, however, is fully planar at the bottom, i.e. the planar, horizontal surface 45 extends all the way to the bottom of the groove 36. Reference numerals 52' and 51' indicate boundary lines of a prior-art tongue. As is clearly to be seen from the Figure, it would with such a known design not be possible to easily angle the tongue 38 inwards into the groove 36 since the corner portion 53 of the tongue 38 would strike against the surface 45 of the groove 36. Such a tongue would therefore have to be pressed into the groove if at all possible. Alternatively, it would be necessary to make the groove 36 higher, which would result in an undesirable play in the vertical direction.

It is evident from FIG. 10*a*, however, that according to the invention there may, during the inwards angling, be a space S under the tongue 38 between the vertical planes IP and OP, which permits the tongue to be inwardly angled into the groove. In this embodiment and in the illustrated angular position, this space S extends all the way between the vertical planes IP and OP.

Figure 10B:
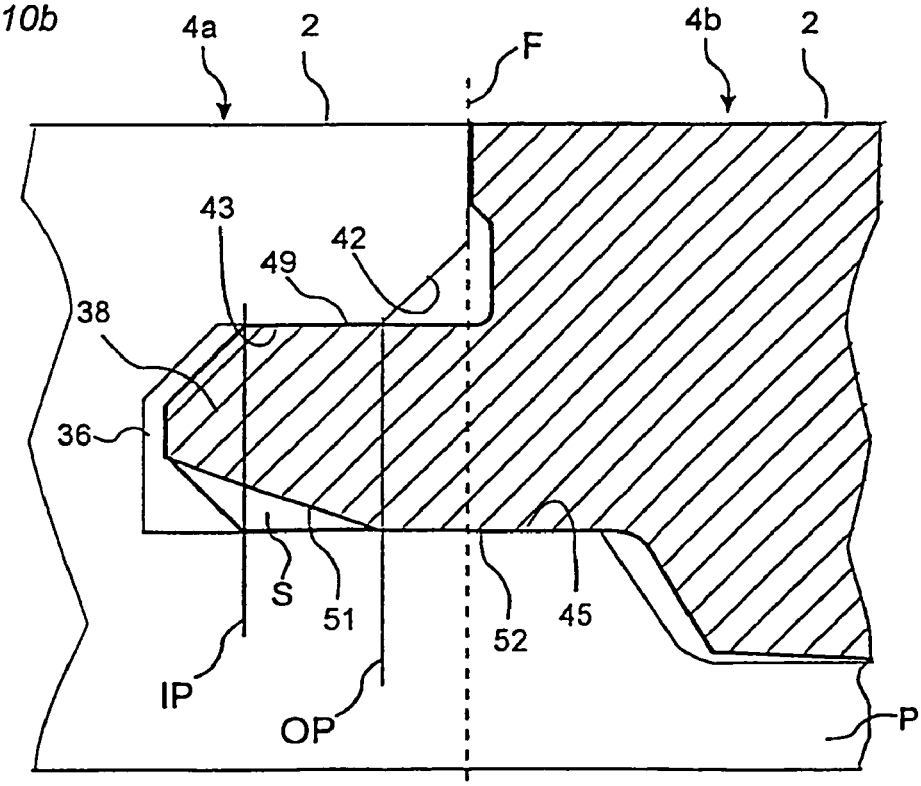

FIG. 10*b* shows the embodiment in FIG. 9 in the joined state. In the area between the inner and outer vertical plane IP and OP there is under the tongue 38 still a space S, which also extends all the way between IP and OP.

Figure 11:
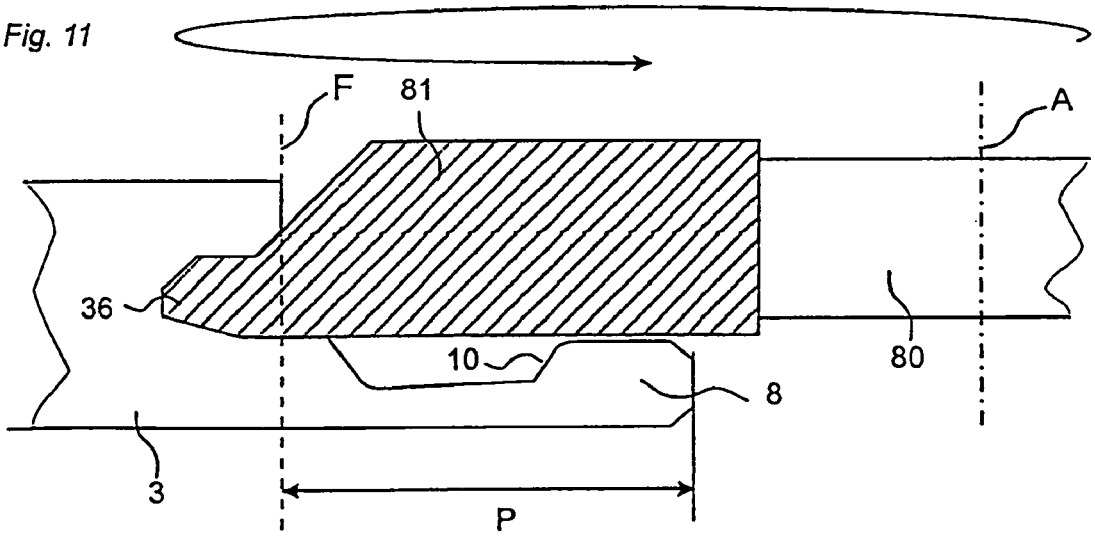
FIG. 11 illustrates the making of the groove in the floorboard in FIG. 9.

FIG. 11 schematically shows the making of the groove 35 in the embodiment in FIG. 9. A rotating working tool 80 with a cutting element 81 of, for instance, hard metal or diamond rotates about an axis A at a distance from the locking element 8. Such horizontal working by means of a tool with a relatively large diameter is possible thanks to the locking element 8 being positioned on the same level or on a level under the lower abutment surface 45 of the groove 36.

In connection with the laying, the major part of the short sides is locked by snap action, as described above with reference to FIGS. 8*a-c*. However, the first row is frequently laid by angling together the short sides, in the same manner as described for the long sides in connection with FIGS. 7*a-c*. When taking up the boards, the short sides can both be pulled apart along the joint and be angled upwards. As a rule, upwards angling is a quicker operation. The inventive locking system should thus be designed while also taking into consideration the possibility of angling the short side.

The aspects of the invention which include a separate strip can preferably be implemented in combination with use of an equalising groove of the kind described in WO 94/26999. Adjacent joint edges are equalised in the thickness direction by working of the underside, so that the upper sides of the floorboards are aligned with each other when the boards have been joined. Reference E in FIG. 1*a* indicates that the body of the boards after such working has the same thickness in adjacent joint edges. The strip 6 is received in the groove and will thus be partly flush-mounted in the underside of the floor. A corresponding arrangement can thus be realised also in combination with the invention as shown in the drawings.

The invention claimed is:

1. A locking system for mechanical joining of floorboards, said locking system comprising a tongue-and-groove joint, the groove and tongue of which have cooperating upper abutment surfaces and cooperating lower abutment surfaces for vertical locking of two joint edges of two adjacent floorboards, said upper abutment surfaces extending in a first plane essentially parallel to a principal plane of the floorboards and said lower abutment surfaces extending in a second plane essentially parallel to the principal plane of the floorboards, and said locking system comprising, for horizontal mechanical joining of the joint edges in a direction perpendicular to the joint edges, a locking groove formed in an underside of a first one of the floorboards and extended in parallel therewith and spaced from the joint edge, and a portion projecting from a second one of the floorboards, said portion supporting, at a distance from the joint edge, a locking element cooperating with the locking groove, wherein said tongue is anglable into the groove, and wherein the locking element is insertable into the locking groove by mutual angular motion of the floorboards about upper portions of the joint edges, wherein in a joined state, the cooperating upper abutment surfaces are in contact with each other and are limited horizontally inwards from the joint edge and horizontally outwards to the joint edge by an inner vertical plane and an outer vertical plane, respectively, the tongue-and-groove joint is so designed that there is in the groove between the inner vertical plane and the outer vertical plane and below the tongue, a space which extends horizontally from the inner vertical plane and at least halfway to the outer vertical plane, an uppermost surface of the locking element is below the first plane, and at least a portion of the lower abutment surfaces are positioned outside the outer vertical plane, wherein in an angling state, the tongue-and-groove joint is further so designed that the floorboards, during a final phase of an inwards angling when the locking element is inserted into the locking groove, can take a position where there is space in the groove between the inner and the outer vertical plane and below the tongue, and wherein the projecting portion is at least partially made in one piece with a body of the floorboard.

2. The locking system as claimed in claim 1, wherein said space in the joined state is horizontally extended below the tongue all the way from the inner vertical plane to the outer vertical plane, so that no part of the lower abutment surfaces is positioned inside the outer vertical plane.

3. The locking system as claimed in claim 1, wherein said space during the final phase of the inwards angling is horizontally extended below the tongue all the way from the inner vertical plane to the outer vertical plane.

4. The locking system as claimed in claim 1, wherein the groove in the joined state has an upper and a lower horizontal surface which constitute inwardly directed extensions of the upper abutment surface and the lower abutment surface, respectively, of the groove, and wherein there is in the joined state a horizontal play between a bottom of the groove and a tip of the tongue.

5. The locking system as claimed in claim 1, wherein the outer vertical plane is located at a horizontal distance inside a vertical joint plane, which is defined by adjoining upper portions of the joined joint edges of the two floorboards.

6. The locking system as claimed in claim 1, wherein the lower abutment surfaces are located at least partially outside a vertical joint plane which is defined by adjoining upper portions of the joined joint edges of the two floorboards.

7. The locking system as claimed in claim 6, wherein the major part of the lower abutment surfaces is positioned outside the vertical joint plane.

8. The locking system as claimed in claim 1, wherein the projecting portion and the groove are arranged in one and the same joint edge of the floorboard.

9. The locking system as claimed in claim 1, wherein the locking element of the projection portion is positioned on a level with or toward an underside of the floorboard from the lower abutment surface of the groove.

10. The locking system as claimed in claim 1, wherein the projecting portion is at least partially formed of a material other than that of a body of the floorboard.

11. The locking system as claimed in claim 10, wherein the projecting portion is at least partially formed of a separate strip which is integrally connected with the board by being mounted in the factory.

12. The locking system as claimed in claim 1, wherein the projecting portion is resilient transversely of the principal plane of the floorboards.

13. The locking system as claimed in claim 1, wherein the tongue is insertable into the groove and the locking element is insertable into the locking groove by a mutual horizontal joining of the joint edges of the boards.

14. The locking system as claimed in claim 13, wherein the groove has in an upper part a beveled portion for guiding the tongue into the groove.

15. The locking system as claimed in claim 1, wherein the projecting portion, in a horizontal direction between the lower abutment surfaces of the tongue-and-groove joint on the one hand and the locking element of the projecting portion on the other hand, has a lower portion which is positioned toward an underside of said floorboard from said lower abutment surfaces.

16. The locking system as claimed in claim 1, wherein the tongue is anglable into the groove and the locking element is insertable into the locking groove by said mutual angular motion of the boards about upper portions of the joint edges while said upper portions are held in mutual contact.

17. A floorboard provided along one or more sides with a locking system as claimed in claim 1.

18. The floorboard as claimed in claim 17, which has opposite long sides and short sides and which is mechanically joinable along each long side with a long side of an identical floorboard by downward angling and which is mechanically joinable along each short side with a short side of an identical floorboard by displacement along said long sides.

19. The locking system of claim 1, wherein the locking system is on each of four edges of a floorboard.

20. The locking system of claim 1, wherein the projecting portion is resilient.

21. The locking system of claim 11, wherein the strip is resilient.

22. The locking system of claim 1, wherein all of the lower abutment surfaces are positioned outside the outer vertical plane.

23. The locking system of claim 1, wherein the upper abutment surface of the locking element is below the second plane.

24. The locking system as claimed in claim 1, wherein the cooperating upper abutment surfaces are at least partially displaced from the cooperating lower abutment surfaces in a displacing direction parallel to the principle plane of the floorboards.

25. The locking system as claimed in claim 1, wherein at least a portion of the lower cooperating abutment surface is horizontally inward from a vertical joint plane defined by a contacting portion of two juxtaposed upper portions of the floorboards, a first juxtaposed upper portion on a first one of the floorboards and a second juxtaposed upper portion on a second one of the floorboards.

26. The locking system as claimed in claim 1, wherein at least a portion of the lower cooperating abutment surface is between the outer vertical plane and a vertical joint plane defined by a contacting portion of two juxtaposed upper portions of the floorboards, a first juxtaposed upper portion on a first one of the floorboards and a second juxtaposed upper portion on a second one of the floorboards.

27. A locking system for mechanical joining of floorboards, the locking system comprising:

a tongue-and-groove joint, the groove and tongue of which have cooperating upper abutment surfaces and cooperating lower abutment surfaces for vertical locking of two joint edges of two adjacent floorboards, wherein the upper abutment surfaces extend in a first plane essentially parallel to a principal plane of the floorboards and the lower abutment surfaces extend in a second plane essentially parallel to the principal plane of the floorboards;

a locking groove formed in an underside of a first one of the floorboards and extended in parallel therewith and spaced from the joint edge; and a portion projecting from a second one of the floorboards, the portion supporting, at a distance from the joint edge, a locking element cooperating with the locking groove, wherein the locking groove and the locking element are for horizontal mechanical joining of the joint edges in a direction perpendicular to the joint edges, wherein both the tongue is anglable into the groove and the locking element is insertable into the locking groove by mutual angular motion of the floorboards about upper portions of the joint edges, wherein in a joined state the cooperating upper abutment surfaces are in contact with each other and the cooperating upper abutment surfaces extend in a contacting state beginning at a first position in the groove at an inner vertical plane and ending at a second position in the groove at an outer vertical plane, wherein the outer vertical plane is closer to the joint edge than the inner vertical plane, and the tongue-and-groove joint includes a space in the groove between the inner vertical plane and the outer vertical plane and below the tongue, the space extending from the inner vertical plane to at least halfway to the outer vertical plane, an uppermost surface of the locking element is below the first plane, and at least a portion of the lower abutment surfaces are positioned between the outer vertical plane and the joint edge, and wherein the projecting portion is at least partially made in one piece with a body of the floorboard.

28. The locking system of claim 27, wherein in an angling state and during a final phase of an inwards angling when the locking element is inserted into the locking groove, the tongue-and-groove joint includes a space in the groove between the inner and the outer vertical plane and below the tongue.

29. The locking system of claim 27, wherein in the joined state, the cooperating lower abutment surfaces are in contact with each other.

30. The locking system of claim 1, wherein an uppermost surface of the locking element is spaced apart from surfaces of the locking groove and wherein a distal-most surface of the locking element is spaced apart from surfaces of the locking groove.

31. The locking system of claim 1, wherein the entire projecting portion is made in one piece with a body of the floorboard.

32. The locking system of claim 27, wherein an uppermost surface of the locking element is spaced apart from surfaces of the locking groove and wherein a distal-most surface of the locking element is spaced apart from surfaces of the locking groove.

33. The locking system of claim 27, wherein the entire projecting portion is made in one piece with a body of the floorboard.

* * * * *